US006704705B1

(12) United States Patent
Kabal et al.

(10) Patent No.: US 6,704,705 B1
(45) Date of Patent: Mar. 9, 2004

(54) PERCEPTUAL AUDIO CODING

(75) Inventors: Peter Kabal, Montreal (CA); Hossein Najafzadeh-Azghandi, Montreal (CA)

(73) Assignee: Nortel Networks Limited, St. Laurent (CA)

( * ) Notice: Subject to any disclaimer, the term of this patent is extended or adjusted under 35 U.S.C. 154(b) by 0 days.

(21) Appl. No.: 09/146,752

(22) Filed: Sep. 4, 1998

(51) Int. Cl.[7] ..... G10L 11/00
(52) U.S. Cl. ..... 704/230; 704/219
(58) Field of Search ..... 704/230, 219

(56) References Cited

U.S. PATENT DOCUMENTS

| | | | | | |
|---|---|---|---|---|---|
| 4,817,157 | A | | 3/1989 | Gerson | 381/40 |
| 5,040,217 | A | | 8/1991 | Brandenburg et al. | 381/47 |
| 5,148,489 | A | * | 9/1992 | Erell et al. | 704/226 |
| 5,179,594 | A | * | 1/1993 | Yip et al. | 704/217 |
| 5,187,745 | A | * | 2/1993 | Yip et al. | 704/219 |
| 5,272,529 | A | * | 12/1993 | Frederiksen | 375/240.22 |
| 5,317,672 | A | | 5/1994 | Crossman et al. | 395/238 |
| 5,481,614 | A | | 1/1996 | Johnston | 381/2 |
| 5,533,052 | A | | 7/1996 | Bhaskar | 375/244 |
| 5,633,980 | A | * | 5/1997 | Ozawa | 704/200.1 |
| 5,651,090 | A | * | 7/1997 | Moriya et al. | 704/200.1 |
| 5,664,057 | A | | 9/1997 | Crossman et al. | 704/229 |
| 5,956,674 | A | * | 9/1999 | Smyth et al. | 704/200.1 |
| 5,978,762 | A | * | 11/1999 | Smyth et al. | 704/229 |
| 6,041,297 | A | * | 3/2000 | Goldberg | 704/219 |
| 6,351,730 | B2 | * | 2/2002 | Chen | 704/229 |

OTHER PUBLICATIONS

Jürgen Herre et al. "Enhancing the Performan of Perceptual Audio Coders by Using Temporal Noise Shaping (TNS)" AES, Nov. 8, 1996.

Marina Bosi et al. "ISO/IEC MPEG–2 Advanced Audio Coding", AES, Nov. 8, 1996.

Martin Dietz et al. "Briding the Gap: Extending MPEG Audio down to 8 kbit/s", AES, Mar. 22, 1997.

Ted Painter, et al. A Review of Algorithms for Perceptual Coding of Digital Audio Signals, Department of Electrical Engineering, Arizona State University.

ISO/IEC "Information technology—Generic coding of moving pictures and associated Audio information Part 7: Advanced audio Coding (AAC)".

James D. Johnston, "Transform Coding of Audio Signals Using Perceptual Noise Criteria", IEEE Journal on Selected Areas in Communications, vol. 6, No. 2, Feb. 1988.

James D. Johnston, "Estimation of Perceptual Entropy Using Noise Masking Criteria", AT&T Bell Laboratories, pp. 2524–2527.

* cited by examiner

*Primary Examiner*—Doris H. To
*Assistant Examiner*—Michael N. Opsasnick

(57) ABSTRACT

A method and apparatus for perceptual audio coding. The method and apparatus provide high-quality sound for coding rates down to and below 1 bit/sample for a wide variety of input signals including speech, music and background noise. The invention provides a new distortion measure for coding the input speech and training the codebooks, where the distortion measure is based on a masking spectrum of the input frequency spectrum. The invention also provides a method for direct calculation of masking thresholds from a modified discrete cosine transform of the input signal. The invention also provides a predictive and non-predictive vector quantizer for determining the energy of the coefficients representing the frequency spectrum. As well, the invention provides a split vector quantizer for quantizing the fine structure of coefficients representing the frequency spectrum. Bit allocation for the split vector quantizer is based on the masking threshold. The split vector quantizer also makes use of embedded codebooks. Furthermore, the invention makes use of a new transient detection method for selection of input windows.

37 Claims, 7 Drawing Sheets

| Critical Band Number | Lower Edge (HZ) | Upper Edge (HZ) | MDCT Coefficients (240 sample window) | MDCT Coefficients (Short Window) | Aggregate Band Number |
|---|---|---|---|---|---|
| 1 | 0 | 100 | 3 | 1 | 1 |
| 2 | 100 | 200 | 3 | 1 | 1 |
| 3 | 200 | 300 | 3 | 1 | 1 |
| 4 | 300 | 400 | 3 | 1 | 2 |
| 5 | 400 | 510 | 3 | 1 | 2 |
| 6 | 510 | 630 | 4 | 1 | 2 |
| 7 | 630 | 770 | 4 | 1 | 2 |
| 8 | 770 | 920 | 5 | 2 | 3 |
| 9 | 920 | 1080 | 5 | 2 | 3 |
| 10 | 1080 | 1270 | 5 | 2 | 4 |
| 11 | 1270 | 1480 | 7 | 2 | 4 |
| 12 | 1480 | 1720 | 7 | 2 | 5 |
| 13 | 1720 | 2000 | 8 | 3 | 5 |
| 14 | 2000 | 2320 | 10 | 3 | 6 |
| 15 | 2320 | 2700 | 12 | 4 | 6 |
| 16 | 2700 | 3150 | 13 | 4 | 7 |
| 17 | 3150 | 3700 | 13 | 5 | 7 |
| 18 | 3700 | 4000 | Not used | Not used | * |

FIGURE 4

BIT ALLOCATION

REGULAR AND TRANSITIONAL WINDOWS

| Description | Bits |
|---|---|
| Gain Quantization | |
| Average Log Energy ($g_n$) | |
| (i) Index to Average Log Energy difference ($\delta_{n(best)}$) | 5 |
| Predictive: | |
| Energy in each band ($O_i$) | |
| (i) Index to Residual Energy ($r_{best}$, $s_{best}$) | 22 (2 x 11) |
| (ii) Predictor Coefficients ($m_{best}$) | 6 |
| Non-predictive: | |
| (i) Index to Residual Energy ($r_{best}$, $s_{best}$) | 24 (2 x 12) |
| (ii) Not used | 4 |
| Split VQ Codebooks Indices (Vi) | 85 |
| Window Selection | 1 |
| Non-predictive Gain Quantization Selection | 1 |

SHORT WINDOWS

| | |
|---|---|
| Gain Quantization | |
| Average Log Energy ($g_n$) | |
| (i) Index to Average Log Energy difference ($\delta_{n(best)}$) | 3 |
| Energy in each band ($O_i$) | |
| (i) Index to Residual Energy ($r_{best}$) | 8 (1 x 8) |
| (ii) Predictor Coefficients ($m_{best}$) | 3 |
| Split VQ Codebooks Indices (Vi) | 25 |
| Window Selection | 1 |

FIGURE 5

| Present Window | Ejmax | Next Window |
|---|---|---|
| Regular | $<$ Threshold | Regular |
| Regular | $>$ Threshold | First Transitional |
| First Transitional | $<$ Threshold | Second Transitional |
| First Transitional | $>$ Threshold | Three Short |
| Second Transitional | $<$ Threshold | Regular |
| Second Transitional | $>$ Threshold | First Transitional |
| Three Short | $<$ Threshold | Second Transitional |
| Three Short | $>$ Threshold | Three Short |

FIGURE 7

PERCEPTUAL AUDIO CODING

FIELD OF THE INVENTION

The present invention relates to a transform coder for speech and audio signals which is useful for rates down to and below 1 bit/sample. In particular it relates to using perceptually-based bit allocation in order to vector quantize the frequency-domain representation of the input signal. The present invention uses a masking threshold to define the distortion measure which is used to both train codebooks and select the best codewords and coefficients to represent the input signal.

BACKGROUND OF THE INVENTION

There is a need for bandwidth efficient coding of a variety of sounds such as speech, music, and speech with background noise. Such signals need to be efficiently represented (good quality at low bit rates) for transmission over wireless (e.g. cell phone) or wireline (e.g. telephony or Internet) networks. Traditional coders, such as code excited linear prediction or CELP, designed specifically for speech signals, achieve compression by utilizing models of speech production based on the human vocal tract. However, these traditional coders are not as effective when the signal to be coded is not human speech but some other signal such as background noise or music. These other signals do not have the same typical patterns of harmonics and resonant frequencies and the same set of characterizing features as human speech. As well, production of sound from these other signals cannot be modelled on mathematical models of the human vocal tract. As a result, traditional coders such as CELP coders often have uneven and even annoying results for non-speech signals. For example, for many traditional coders music-on-hold is coded with annoying artifacts.

SUMMARY OF THE INVENTION

An object of the present invention is to provide a transform coder for speech and audio signals for rates down to near 1 bit/sample.

In accordance with an aspect of the present invention there is provided a method of transmitting a discretly represented frequency signal within a frequency band, said signal discretely represented by coefficients at certain frequencies within said band, comprising the steps of: (a) providing a codebook of codevectors for said band, each codevector having an element for each of said certain frequencies; (b) obtaining a masking threshold for said frequency signal; (c) for each one of a plurality of codevectors in said codebook, obtaining a distortion measure by the steps of: for each of said coefficients of said frequency signal (i) obtaining a representation of a difference between a corresponding element of said one codevector and (ii) reducing said difference by said masking threshold to obtain an indicator measure; summing those obtained indicator measures which are positive to obtain said distortion measure; (d) selecting a codevector having a smallest distortion measure; (e) transmitting an index to said selected codevector.

In accordance with another aspect of the present invention there is provided a method method of transmitting a discretely represented frequency signal, said signal discretely represented by coefficients at certain frequencies, comprising the steps of: (a) grouping said coefficients into frequency bands; (b) for each band: providing a codebook of codevectors, each codevector having an element corresponding with each coefficient within said each band; obtaining a representation of energy of coefficients in said each band; selecting a set of addresses which address at least a portion of said codebook such that a size of said address set is directly proportional to energy of coefficients in said each band indicated by said representation of energy; selecting a codevector from said codebook from amongst those addressable by said address set to represent said coefficients for said band and obtaining an index to said selected codevector; (d) concatenating said selected codevector addresses; and (e) transmitting said concatenated codevector addresses and an indication of each said representation of energy.

In accordance with a further aspect of the invention, there is provided a method of receiving a discretly represented frequency signal, said signal discretely represented by coefficients at certain frequencies, comprising the steps of: providing pre-defined frequency bands; for each band providing a codebook of codevectors, each codevector having an element corresponding with each of said certain frequencies which are within said each band; receiving concatenated codevector addresses for said bands and a per band indication of a representation of energy of coefficients in each band; determining a length of address for each band based on said per band indication of a representation of energy; parsing said concatenated codevector addresses based on said address length determining step; addressing said codebook for each band with a parsed codebook address to obtain frequency coefficients for each said band.

A transmitter and a receiver operating in accordance with these methods are also provided.

In accordance with a further aspect of the present invention there is provided a method of obtaining a codebook of codevectors which span a frequency band discretely represented at pre-defined frequencies, comprising the steps of: receiving training vectors for said frequency band; receiving an initial set of estimated codevectors; associating each training vector with a one of said estimated codevectors with respect to which it generates a smallest distortion measure to obtain associated groups of vectors; partitioning said associated groups of vectors into Voronoi regions; determining a centroid for each Voronoi region; selecting each centroid vector as a new estimated codevector; repeating from said associating step until a difference between new estimated codevectors and estimated codevectors from a previous iteration is less than a pre-defined threshold; and populating said codebook with said estimated codevectors resulting after a last iteration.

According to yet a further aspect of the invention, there is provided a method of generating an embedded codebook for a frequency band discretely represented at pre-defined frequencies, comprising the steps of: (a) obtaining an optimized larger first codebook of codevectors which span said frequency band; (b) obtaining an optimized smaller second codebook of codevectors which span said frequency band; (c) finding codevectors in said first codebook which best approximate each entry in said second codebook; (d) sorting said first codebook to place said codevectors found in step (c) at a front of said first codebook.

An advantage of the present invention is that it provides a high quality method and apparatus to code and decode non-speech signals, such as music, while retaining high quality for speech.

BRIEF DESCRIPTION OF THE DRAWINGS

The present invention will be further understood from the following description with references to the drawings in which:

FIG. 4 illustrates, in a table, the allocation of modified discrete cosine transform (MDCT) coefficients to critical bands and aggregated bands, and the boundaries, in Hertz, of the critical bands in accordance with an embodiment of the present invention.

FIG. 5 illustrates, in a table, the allocation of bits passing from the transmitter to the receiver for regular length windows and short windows in accordance with an embodiment of the present invention.

FIG. 7 illustrates, in a truth table, rules for switching between input windows, in accordance with an embodiment of the present invention.

DETAILED DESCRIPTION OF THE PREFERRED EMBODIMENTS

The human auditory system extends from the outer ear, through the internal auditory organs, to the auditory nerve and brain. The purpose of the entire hearing system is to transfer the sound waves that are incident on the outer ear first to mechanical energy within the physical structures of the ear, and then to electrical impulses within the nerves and finally to a perception of the sound in the brain. Certain physiological and psycho-acoustic phenomena affect the way that sound is perceived by people. One important phenomenon is masking. If a tone with a single discrete frequency is generated, other tones with less energy at nearby frequencies will be imperceptible to a human listener.

This masking is due to inhibition of nerve cells in the inner ear close to the single, more powerful, discrete frequency.

Figure 1:
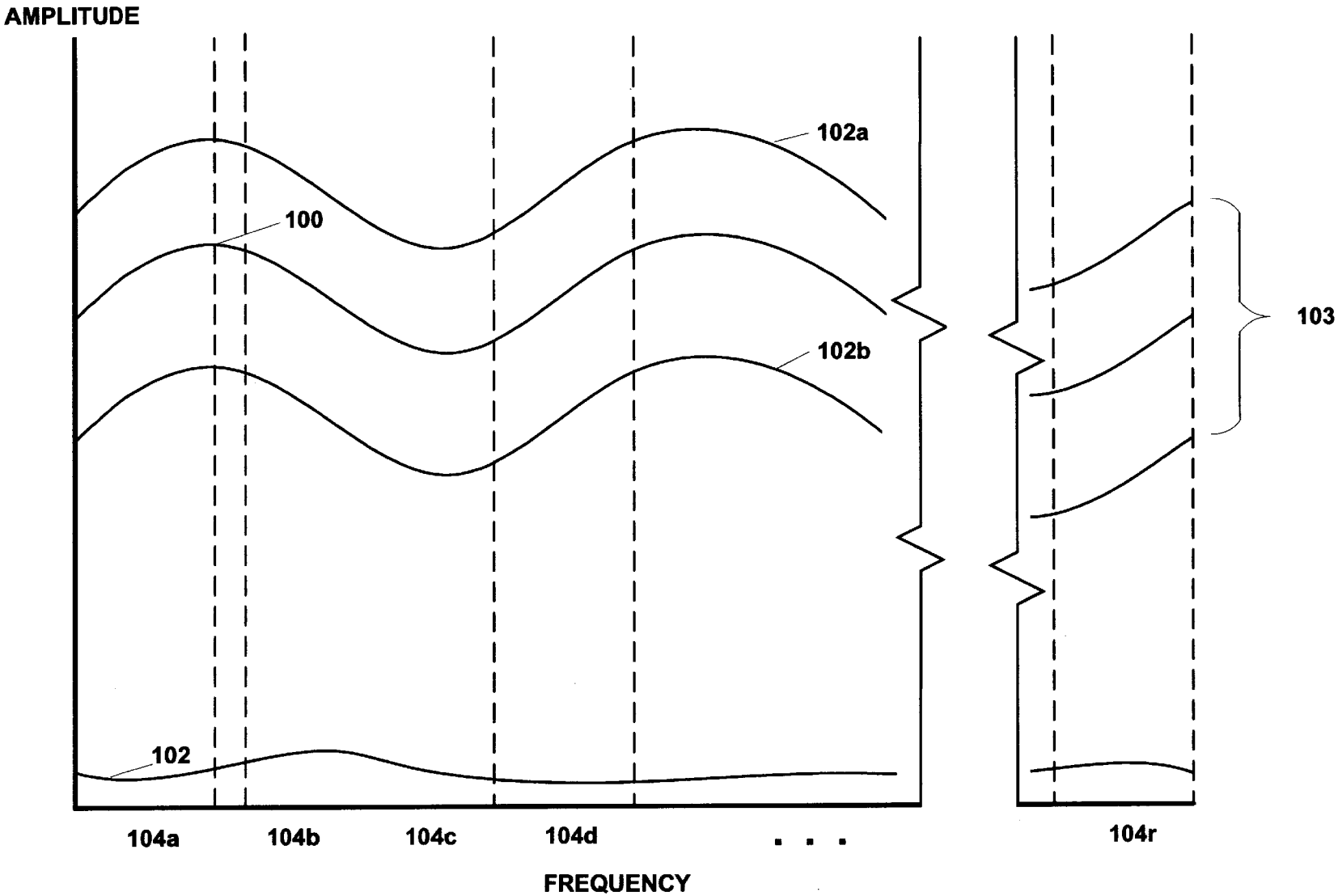
FIG. 1 illustrates a frequency spectrum of an input sound signal.

Referring to FIG. 1, there is illustrated a frequency spectrum 100 of an input sound signal. The y-axis (vertical axis) of the graph illustrates the amplitude of the signal at each particular frequency in the frequency domain, with the frequency being found in ascending order on the x-axis (horizontal axis). For any given input signal, a masking threshold spectrum 102 will exist. The masking threshold is caused by masking in the human ear and is relatively independent of the particular listener. Because of masking in the ear, any amplitude of sound below the masking threshold at a given frequency will be inaudible or imperceivable to a human listener. Thus, given the presence of frequency spectrum 100, any tone (single frequency sound) having an amplitude falling below curve 102 would be inaudible. Furthermore, a dead zone 103 may be defined between a curve 102*a*, which is defined by the addition (in the linear domain) of spectrum 100 and 102, and a curve 102*b*, which is defined by subtracting (in the linear domain) spectrum 102 from spectrum 100. Any sound falling within the dead zone is not perceived as different from spectrum 100. Put another way, curve 102*a* and 102*b* each define masking thresholds with respect to spectrum 100.

Temporal masking of sound also plays an important role in human auditory perception. Temporal masking occurs when tones are sounded close in time, but not simultaneously. A signal can be masked by another signal that occurs later; this is known as premasking. A signal can be masked by another signal that ends before the masked signal begins; this is known as postmasking. The duration of premasking is less than 5 ms, whereas that of postmasking is in the range of 50 to 200 ms.

Generally the perception of the loudness or amplitude of a tone is dependent on its frequency. Sensitivity of the ear decreases at low and high frequencies; for example a 20 Hz tone would have to be approximately 60 dB louder than a 1 kHz tone in order to be perceived to have the same loudness. It is known that a frequency spectrum such as frequency spectrum 100 can be divided into a series of critical bands 104*a* . . . 104*r*. Within any given critical band, the perceived loudness of a tone of the same amplitude is independent of its frequency. At higher frequencies, the width of the critical bands is greater. Thus, a critical band which spans higher frequencies will encompass a broader range of frequencies than a critical band encompassing lower frequencies. The boundaries of the critical bands may be identified by abrupt changes in subjective (perceived) response as the frequency of the sound goes beyond the boundaries of the critical band. While critical bands are somewhat dependent upon the listener and the input signal, a set of eighteen critical bands has been defined which functions as a good population and signal independent approximation. This (about the $18^{th}$ band) set is shown in the table of FIG. 4.

In a transform coder, error can be introduced by quantization error, such that a discrete representation of the input speech signal does not precisely correspond to the actual input signal. However, if the error introduced by the transform coder in a critical band is less than the masking threshold in that critical band, then the error will not be audible or perceivable by a human listener. Because of this, more efficient coding can be achieved by focussing on coding the difference between the deadzone 103 and the quantized signal in any particular critical band.

Figure 2:
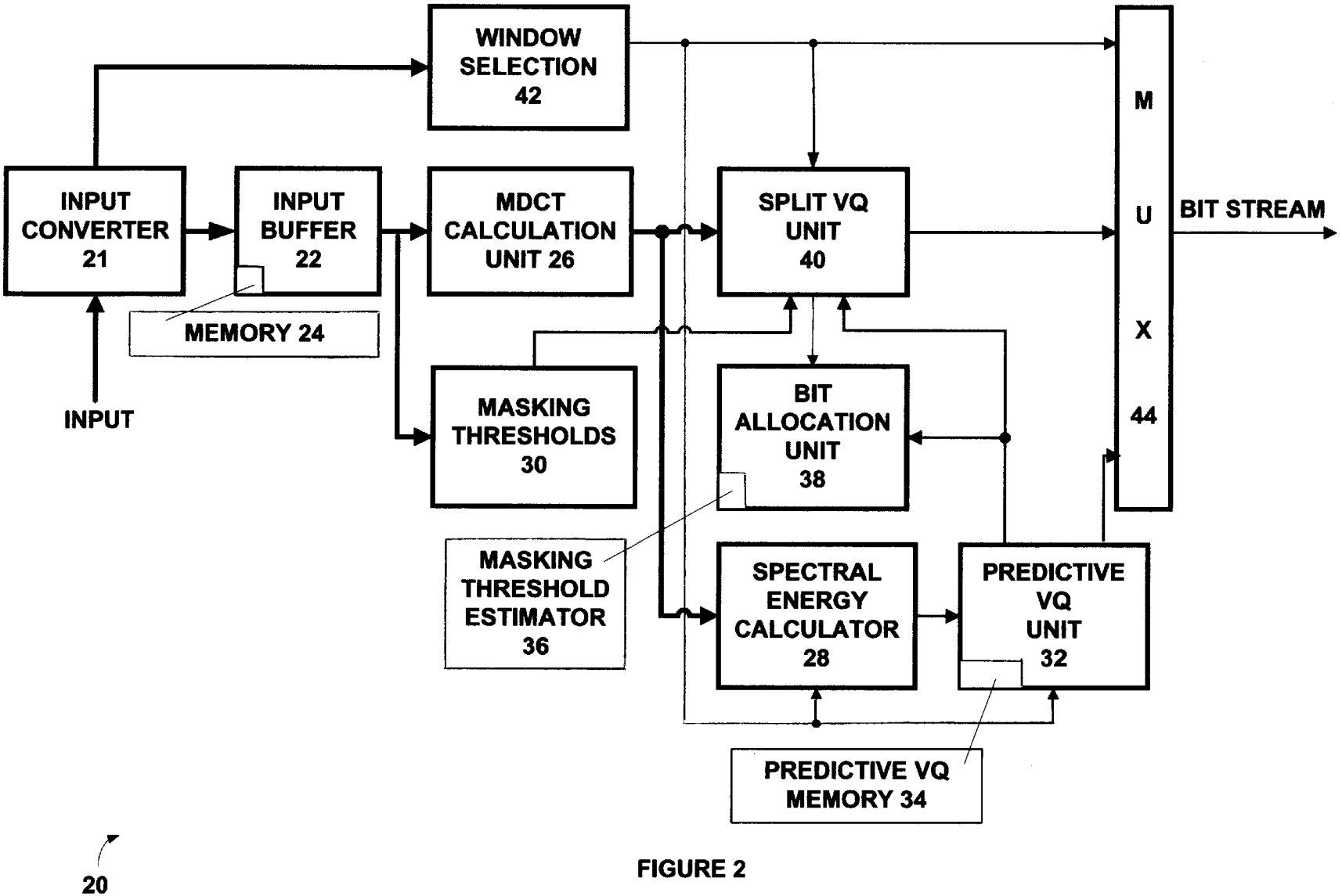
FIG. 2 illustrates, in a block diagram, a transmitter in accordance with an embodiment of the present invention.

Referring now to FIG. 2, there is illustrated, in a block diagram, a transmitter 20 in accordance with an embodiment of the present invention. Input signals, which may be speech, music, background noise or a combination of these are received by input buffer 22. Before being received by input buffer 22, the input signals have been converted to a linear PCM coding in input convertor 21. In the preferred embodiment, the input signal is converted to 16-bit linear PCM. Input buffer 22 has memory 24, which allows it to store previous samples. In the preferred embodiment, when using an ordinary window length, each window (i.e., frame) comprises 120 new samples of the input signal and 120 immediately previous samples. When sampling at 8 kHz, this means that each sample occurs every 0.125 ms. There is a 50% overlap between successive frames which implies a higher frequency resolution while maintaining critical sampling. This overlap also has the advantage of reducing block edge effects which exist in other transform coding systems. These block edge effects can result in a discontinuity between successive frames which will be perceived by the listener as an annoying click. Since quantization error spreading over a single window length can produce pre-echo artifacts, a shorter window with a length of 10 ms is used whenever a strong positive transient is detected. The use of a shorter window will be described in greater detail below.

For each received frame of 240 samples (120 current and 120 previous samples) the samples are passed to modified discrete cosine transform calculation (MDCT) unit 26. In MDCT unit 26, the input frames are transformed from the time domain into the frequency domain. The modified discrete cosine transform is known to those skilled in the art and was suggested by Princen and Bradley in their paper "Analysis/synthesis filter bank design based on time-domain aliasing cancellation" IEEE Trans. Acoustics, Speech, Signal Processing, vol. 34, pp. 1153–1161, October 1986 which is hereby incorporated by reference for all purposes. When the input frames are transformed into the frequency domain by the modified discrete cosine transform, a series of 120 coefficients is produced which is a representation of the frequency spectrum of the input frame. These coefficients are equally spaced over the frequency spectrum and are grouped according to the critical band to which they correspond. While eighteen critical bands are known, in the preferred embodiment of the subject invention, the 18th band from 3700 to 4000 kHz is ignored leaving seventeen critical bands. Because critical bands are wider at higher frequencies, the number of coefficients per critical band varies. At low frequencies there are 3 coefficients per critical band, whereas at higher frequencies there are up to 13 coefficients per critical band in the preferred embodiment.

Average Energy and Energy in Each Band

These grouped coefficients are then passed to spectral energy calculator 28. This calculates the energy or power spectrum in each of the 17 critical bands according to the formula:

$$G_i = \sum_{k=0}^{Li-1} |X_k^{(i)}|^2 \quad (1)$$

Where Gi is the energy spectrum of the ith critical band; $X_{k(i)}$ is the kth coefficient in the ith critical band; and, Li is the number of coefficients band i.

In the logarithmic domain, $O_i = 10 \log_{10} G_i$, where $O_i$ is the log energy for the $i^{th}$ critical band The 17 values for the log energy of the critical bands of the frame ($O_i$) are passed to predictive vector quantizer (VQ) 32. The function of predictive VQ 32 is to provide an approximation of the 17 values of the log energy spectrum of the frame ($O_1 \ldots O_{17}$) in such a way that the log energy spectrum can be transmitted with a small number of bits. In the preferred embodiment, predictive VQ 32 combines an adaptive prediction of both the shape and the gain of the 17 values of the energy spectrum as well as a two stage vector quantization codebook approximation of the 17 values of the energy spectrum. Predictive VQ 32 functions as follows:

(I) The average log energy spectrum is quantized. First, the average log energy, $g_n$, of the power spectrum is calculated according to the formula:

$$g_n = \Sigma O_i/17 \text{ (for } i=1 \text{ to } 17)$$

In the preferred embodiment, the average log energy is not transmitted from the transmitter to the receiver. Instead, an index to a codebook representation of the quantized difference signal between $g_n$ and the quantized value of the difference signal for the previous frame $\hat{g}_{n-1}$ is transmitted. In other words, $$\delta_n = g_n - \alpha \cdot \hat{g}_{n-1}$$

where $\delta_n$ is the difference between $g_n$ and the scaled average log energy for the previous frame $\hat{g}_{n-1}$;

$\alpha$ is a scaling or leakage factor which is just less than unity.

The value of $\delta_n$ is then compared to values in a codebook (preferably having $2^5$ elements) stored in predictive VQ memory 34. The index corresponding to the closest match, $\delta_{n(best)}$, is selected and transmitted to the receiver. The value of this closest match, $\delta_{n(best)}$, is also used to calculate a quantized representation of the average log energy which is found according to the formula:

$$\hat{g}_{n-\delta n(best)} + \alpha \hat{g}_{n-1}$$

(II) The energy spectrum is then normalized. In the preferred embodiment this is accomplished by subtracting the quantized average log energy, $\hat{g}_n$, from the log energy for each critical band. The normalized log energy $O_{Ni}$ is found according to the following equation:

$$O_{Ni} = O_i - \hat{g}_n, \text{ for } i \text{ from 1 to 17}$$

(III) The normalized energy vector for the $n^{th}$ frame $\{O_{Ni}(n))\}$ is then predicted (i.e., approximated) using the previous value of the normalized, quantized energy vector $\{\hat{O}_{Ni}(n-1)\}$ which had been stored in predictive VQ memory 34 during processing of the previous frame. The energy vector $\{\hat{O}_{Ni}(n-1)\}$ is multiplied by each of 64 prediction matrices $M_m$ to form the predicted normalized energy vector $\{\tilde{O}_{Ni}(m)\}$:

$$\{\tilde{O}_{Ni}(m)\} = M_m \cdot \{\hat{O}_{Ni}(n-1)\}$$

Each of the $\{\tilde{O}_{Ni}(m)\}$ is compared to the $O_{Ni}(n)$ using a known method such as a least squares difference. The $\{\tilde{O}_{Ni}(m)\}$ most similar to the $\{O_{Ni}(n)\}$ is selected as the predicted value. The same prediction matrices $M_m$ are stored in both the transmitter and the receiver and so it will be necessary to only transmit the index value m corresponding to the best prediction matrix for that frame (i.e. $m_{best}$). Preferably the prediction matrix $M_m$ is a tridiagonal matrix, which allows for more efficient storage of the matrix elements. The method for calculating the prediction matrices $M_m$ is described below.

(IV) $\{\tilde{O}_{Ni}(m_{best})\}$ will not be identical to $\{O_{Ni}\} \cdot \{\tilde{O}_{Ni}(m_{best})\}$ is subtracted from $\{O_{Ni}\}$ to yield a residual vector $\{R_i\}$. $\{R_i\}$ is then compared to a first $2^{11}$ element codevector codebook stored in predictive VQ memory 34 to find the codebook vector $\{R'_i(r)\}$ nearest to $\{R_i\}$. The comparison is performed by a Least squares calculation. The codebook vector $\{R'_i\}$ $(r_{best})$ which is most similar to $R_i$ is selected. Again both the transmitter and the receiver have identical codebooks and so only the index, $r_{best}$, to the best codebook vector needs to be transmitted from the transmitter to the receiver.

(V) $\{R'_i(r_{best})\}$ will not be identical to $\{R_i\}$ so a second residual is calculated $\{R''_i\} = \{R_i\} - \{R'_i(r_{best})\}$. Second residual $\{R''_i\}$ is then compared to a second $2^{11}$ element codebook stored in predictive VQ memory 34 to find the codebook vector $\{R'''_i\}$ most similar to second residual $\{R''_i\}$. The comparison is performed by a least squares calculation. The codebook vector $\{R'''_i(s_{best})\}$ which is most similar to $\{R''_i\}$ is selected. Again both the transmitter and the receiver have identical codebooks and so only the index, $s_{best}$, to the best codebook vector from the second $2^{11}$ element codebook needs to be transmitted from the transmitter to the receiver.

(VI) The final predicted $\{\hat{O}N_i(n)\}$ is calculated by adding $\{\tilde{O}N_i(m_{best})\}$ from step (III) above, to $\{R'_i(r_{best})\}$ and then to $\{R''_i(s_{best})\}$. In other words, $$\{\hat{O}N_i(n)\}=\{\tilde{O}N_i(m_{best})\}+\{R'_i(r_{best})\}+\{R''_i(s_{best})\}.$$

(VII) The final predicted values $\hat{O}_{Ni}(n)$ are then added to $\hat{g}_n$ to create an unnormalized representation of the predicted (i.e., approximated) log energy of the $i^{th}$ critical band of the $n^{th}$ frame, $\hat{O}_i(n)$:

$$\hat{O}_i(n)=\hat{O}_{Ni}(n)+\hat{g}_n$$

The index values $m_{best}$, $r_{best}$, and $s_{best}$ are transmitted to the receiver so that it may recover an indication of the per band energy.

The predictive method is preferred where there are no large changes in energy in the bands between frames, i.e. during steady state portions of input sound. Thus, in the preferred embodiment, if an average difference between $\{\hat{O}_{Ni}(m_{best})\}$ and $\{O_{Ni}(n)\}$ is less, than 4 dB the above steps (IV)–(VII) are used. The average difference is calculated according to the equation.

$$\sum_L \left|\tilde{O}_{Ni}(m_{best})-O_{Ni}\right|/17$$

However, if the average difference between $\{\tilde{O}_{Ni}(m_{best})\}$ and $\{O_{Ni}(n)\}$ is greater than 4 dB, a non-predictive gain quantization is used. In non-predictive gain quantization $\tilde{O}_{Ni}(m_{best})$ is set to zero, i.e. step (III) above is omitted. Thus the residual $\{R_i\}$ is simply $\{O_{Ni}\}$. A first $2^{12}$ element non-predictive codebook is searched to find the codebook vector $\{R_i(r)\}$ nearest to $\{R_i\}$. The most similar codevector is selected and a second residual is calculated. This second residual is compared to a second $2^{12}$ element non-predictive codebook. The most similar codevector to the second residual is selected. The indices to the first and second codebooks $r_{best}$ and $s_{best}$, are then transmitted from transmitter to receiver, as well as a bit indicating that non-predictive gain quantization has been selected.

Note that since each of $\{\hat{O}_i(n)\}$ and $\hat{g}(n)$ are dependent upon $\{\hat{O}_{Ni(n-1)}\}$ and $\hat{g}(n-1)$, respectively, for the first frame of a given transmission, the non-predictive gain quantization selection flag is set for the first frame and the non-predictive VQ coder is used. Alternatively, when transmitting the first frame of a given transmission, the value of $\hat{g}_{n-1}$ could be set to 0 and the values of $\hat{O}_{Ni}(n-1)$ could be set to 1/17.

As a further alternative, when transmitting the first frame nothing different needs to be done, because the predictor structures for finding $\hat{g}_n$ and $\hat{O}_{Ni}(n)$ will soon find the correct values after a few frames.

It should be noted that alternatively, one could use linear prediction to calculate the spectral energy. This would occur in the following manner. Based on past frames, a linear prediction could be made of the present spectral energy contour. The linear prediction (LP) parameters could be determined to give the best fit for the energy contour. The LP parameters would then be quantized. The quantized parameters would be passed through an inverse LPC filter to generate a reconstructed energy spectrum which would be passed to bit allocation unit 38 and to split VQ unit 40. The quantized parameters for each frame would be sent to the receiver.

Masking Threshold Estimation $\{\hat{O}_i(n)\}$ is then passed to masking threshold estimator 36 which is part of bit allocation unit 38. Masking threshold estimator 36 then calculates the masking threshold values for the signal represented by the current frame in the following manner:

(A) The values of the quantized power spectral density function $\hat{O}_i$ are converted from the logarithmic domain to the linear domain:

$$\hat{G}_i=10^{\wedge}(\hat{O}_i/10)$$

(B) A spreading function is convolved with the linear representation of the quantized energy spectrum. The spreading function is a known function which models the masking in the human auditory system. The spreading function is:

$$SpFn(z)=10^{(15.8114+7.5(z+0.474)-17.5\sqrt{1+(z+.474)^2})/10)}$$

where $$z=i-j$$

$$i,j=1, \ldots, 17$$

i being an index to a given critical band and j being an index to each of the other critical bands.

In the result, there is one spreading function for each critical band.

For simplicity let $SpFn(z)=S_z$

The spreading function must first be normalized in order to preserve the power of the lowest band. This is done first by calculating the overall gain due to the spreading function $g_{SL}$:

$$g_{sL}=\Sigma S_z \text{ for } z=0 \text{ to } L-1$$

Where $S_z$ is the value of the spreading function; and

L is the total number of critical bands, namely 17.

Then the normalized spreading function values $S_{zN}$ are calculated:

$$S_{zN}=S_z/G_{SL}$$

Then the normalized spreading function is convolved with the linear representation of the normalized quantized power spectral density $G_i$, the result of the convolution being $\hat{G}_{Si}$:

$$\hat{G}_{Si}=\hat{G}_i*S_{iN}=\Sigma S_{zN}, \hat{G}_{i-z}, \text{ for } z=0 \text{ to } L-1$$

This creates another set of 17 values which are then converted back into the logarithmic domain:

$$\hat{O}_{Si}=10 \log_{10} \hat{G}_{Si}$$

(C) A spectral flatness measure, a, is used to account for the noiselike or tonelike nature of the signal. This is done because the masking effect differs for tones compared to noise. In masking threshold estimator 36, a is set equal to 0.5.

(D) An offset for each band is calculated. This offset is subtracted from the result of the convolution of the normalized spreading function with the linear representation of the quantized energy spectrum. The offset, $F_i$, is calculated according to the formula:

$$F_i=5.5\ (1-a)+(14.5+i)\ a$$

Where $F_i$ is the offset for the ith band;

a is the chosen spectral flatness measure for the frame, which in the preferred embodiment is 0.5; and i is the number of the critical band.

(E) The masking threshold for each critical band, $T_i$, is then calculated:

$$T_i=\hat{O}_{Si}-F_i$$

Thus, a fixed masking threshold estimate is determined for each critical band.

Bit Allocation

An important aspect of the preferred embodiment of the present invention is that bits that will be allocated to represent the shape of the frequency spectrum within each critical band are allocated dynamically and the allocation of bits to a critical band depends on the number of MDCT coefficients per band, and the gap between the MDCT coefficients and the dead zone for that band. The gap is indicative of the signal-to-noise ratio required to drive noise below the masking threshold.

The gap for each band $Gap_i$ (of the nth frame), is calculated in bit allocation unit 38 in the following manner:

$$Gap_i=\hat{O}_i-T_i$$

(Note that $\hat{O}_i$ and $T_i$—which is based on $\hat{O}_i$—are used to determine $Gap_i$ rather than the more accurate value $O_i$. This is for the reason that only $\hat{O}_i$ will be available at the receiver for recreating the bit number allocation, as is described hereafter.)

Using the values of $Gap_i$ that have been calculated, the first approximation of the number of bits to represent the shape of the frequency spectrum within each critical band, $b_i$, is calculated:

$$b=\lfloor Gap_i \cdot L_i \cdot b_d/(\Sigma Gap_i \cdot L \text{ for all } i)\rfloor$$

Where $b_d$ is the total number of bits available for transmission between the transmitter and the receiver to represent the shape of the frequency spectrum within the critical bands;

$\lfloor \ldots \rfloor$ represents the floor function which provides that the fractional results of the division are discarded, leaving only the integer result; and Li is the number of coefficients in the ith critical band.

However, it should be noted that in the preferred embodiment the maximum number of bits that can be allocated to any band, when using regular and transitional windows (which are detailed hereinafter), is limited to 11 and is limited to 7 bits for short windows (which are detailed hereinafter). It also should be noted that as a result of using the floor function the number of bits allocated in the first approximation will be less than $b_d$ (the total number of bits available for transmission between the transmitter and the receiver to represent the shape of the frequency spectrum within the critical bands). To allocate the remaining bits, a modified gap, $Gap'_i$, is calculated which takes into account the bits allocated in the first approximation.

$$Gap'_i=\hat{O}_i-T_i-6\cdot b_i/L_i$$

Wherein 6 represents the increase in the signal to noise ratio caused by allocating an additional bit to that band. The value of $Gap'_i$ is calculated for all critical bands. An additional bit is then allocated to the band with the largest value of $Gap'_i$. The value of $b_i$ for that band is incremented by one, and then $Gap'_i$ is recalculated for all bands. This process is repeated until all remaining bits are allocated. It should be noted that instead of using the formula $b_i=\lfloor Gap_i \cdot L_i \cdot b_d/(\Sigma Gap_i\ L_i$, for all i) $\rfloor$ to make a first approximation of bit allocation, $b_i$ could have been set to zero for all bands, and then the bits could be allocated by calculating $Gap'_i$, allocating a bit to the band with the largest value of $Gap'_i$, and then repeating the calculation and allocation until all bits are allocated. However, the latter approach requires more calculations and is therefore not preferred.

Codevector Selection

Bit allocation unit 38 then passes the 17 dimensional $b_i$ vector to split VQ unit 40. Split VQ unit 40 will find vector codewords (codevectors) that best approximate the relative amplified of the frequency spectrum (i.e. the MDCT coefficients) within each critical band. In split VQ unit 40, the frequency spectrum is split into each of the critical bands and then a separate vector quantization is performed for each critical band. This has the advantage of reducing the complexity of each individual vector quantization compared to the complexity of the codebook if the entire spectrum were to be vector quantized at the same time.

Because the actual values of each $O_i$, the energy spectrum of the ith critical band, are available at the transmitter, they are used to calculate a more accurate masking threshold which allow a better selection of vector codewords to approximate the fine detail of the frequency spectrum. This calculation will be more accurate than if the quantized version, $\hat{O}_i$, had been used. Similarly, a more accurate calculation of a, the spectral flatness measure, is used so that the masking thresholds that are calculated are more representative.

Spectral energy calculator 28 has already calculated the energy or power spectrum in each of the 17 critical bands according to the formula:

$$G_i=\sum_{k=0}^{Lj-1}|X_k^{(i)}|^2. \tag{1}$$

Where $G_i$ is the power spectral density of the ith critical band; and $X_{k(i)}$ is the kth coefficient in the ith critical band.

The previously set out spreading function is convolved with the linear representation of the quantized power spectral density function. Recall, this spreading function is:

$$SpFn(z)=10^{(15.8114+7.5(z+0.474)-17.5\sqrt{1+(z+0.474)^2})/10)}$$

where $$z=i-j$$

$$i,j=1, \ldots 17$$

Again, for simplicity let $SpFn(z)=S_z$ and, as before, this spreading function is normalized in order to preserve the power of the lowest band. This is done first by calculating the overall gain due to the spreading function $g_{SL}$:

$$g_{SL}=\Sigma S_z \text{ for } z=0 \text{ to } L-1$$

Where $S_z$ is the value of the spreading function; and

L is the total number of critical bands, namely 17.

Then the normalized spreading function values $S_{zN}$ are calculated:

$$S_{zN}=S_z/g_{SL}$$

Then the normalized spreading function is convolved with the linear representation of the normalized unquantized power spectral density $G_i$, the result of the convolution being $G_{Si}$:

$$G_{Si}=G_i{}^*S_{iN}=\Sigma S_{zN}G_{i-z}, \text{ for } z=0 \text{ to } L-1$$

This creates another set of 17 values which are then converted into the logarithmic domain:

$$O_{Si}=10 \log_{10} G_{Si}$$

A spectral flatness measure, a, is used to account for the noiselike or tonelike nature of the signal. The spectral flatness measure is calculated by taking the ratio of the geometric mean of the MDCT coefficients to the arithmetic mean of the MDCT coefficients.

$$a=((\Pi X_i, \text{ for } i=1 \text{ to } N)\hat{}(1/N))/(\Sigma X_i/N \text{ For } i=1 \text{ to } N$$

Where $X_i$ is the ith MDCT coefficient; and,

N is the number of MDCT coefficients.

This spectral flatness measure is used to calculate an offset for each band. This offset is subtracted from the result of the convolution of the normalized spreading function with the linear representation of the unquantized energy spectrum. The result is the masking threshold for the critical band. This is carried out to account for the asymmetry of tonal and noise masking. An offset is subtracted from the set of 17 values produced by the convolution of the critical band with the spreading function. The offset, $F_i$, is calculated according to the formula:

$$F_i=5.5(1-a)+(14.5+i)a$$

Where $F_i$ is the offset for the ith band; and a is the spectral flatness measure for the frame.

The unquantized fixed masking threshold for each critical band, $T_{iu}$, is then calculated:

$$T_{iu}=O_{Si}-F_i$$

The 17 values of $T_{iu}$ are then passed to split VQ unit 40. Split VQ unit 40 determines the codebook vector that most closely matches the MDCT coefficients for each critical band, taking into account the masking threshold for each critical band. An important aspect of the preferred embodiment of the invention is the recognition that it is not worthwhile expending bits to represent a coefficient that is below the masking threshold. As well, if the amplitude of the estimated (codevector) signal within a critical band is within the deadzone, this frequency component of the estimated (codevector) signal will be indistinguishable from the true input signal. As such, it is not worthwhile to use additional bits to represent that component more accurately.

By way of summary, split VQ unit 40 receives MDCT frequency spectrum coefficients, $X_i$, the unquantized masking thresholds, $T_{iu}$, the number of bits that will be allocated to each critical band, $b_i$, and the linear quantized energy spectrum $\hat{G}_i$. This information will be used to determine codebook vectors that best represent the fine detail of the frequency spectrum for each critical band.

The codebook vectors are stored in split VQ unit 40. For each critical band, there is a separate codebook. The codevectors in the codebook have the same dimension as the number of MDCT coefficients for that critical band. Thus, if there are three frequency spectrum coefficients, (at predefined frequencies) representing a particular critical band, then each codevector in the codebook for that band has three elements (points). Some critical bands have the same number of coefficients, for example critical bands 1 through 4 each have three MDCT coefficients when the window size is 240 samples. In an alternative embodiment to the present invention, those critical bands with the same number of MDCT coefficients share the same codebook. With seventeen critical bands, the number of frequency spectrum coefficients for each band is fixed and so is the codebook for each band.

The number of bits that are allocated to each critical band, $b_i$, varies with each frame. If $b_i$ for the ith critical band is 1, this means only one bit will be sent to represent the frequency spectrum of band i. One bit allows the choice between one of two codevectors to represent this portion of the frequency spectrum. In a simplified embodiment, each codebook is divided into sections, one for each possible value of $b_i$. In the preferred embodiment, the maximum value of $b_i$ for a critical band is eleven bits when using regular windows. This then requires eleven sections for each codebook. The first section of each codebook has two entries (with the two entries optimized to best span the frequency spectrum for the ith band), the next four and so on, with the last section having $2^{11}$ entries. With $b_i$ being 1, the first codebook section for the ith band is searched for the codevector best matching the frequency spectrum of the ith band. In a more sophisticated embodiment, each codebook is not divided into sections but contains $2^{11}$ codevectors sorted so that the vectors represent the relative amplitudes of the coefficients in the ith band with progressively less granularity. This is known as an embedded codebook. Then, the number of bits allocated determine the number of different codevectors of the codebook that will be searched to determine the best match of the codevector to the input vector for that band. In other words if 1 bit is allocated to that critical band, the first $2^1=2$ codevectors in the codebook for that critical band will be compared to find the best match. If 3 bits are allocated to that critical band, the first $2^3=8$ codevectors in the codebook for that critical band will be compared to find the best match. For each critical band, the codebook contains, in the preferred embodiment, $2^{11}$ codevectors. The manner of creating an embedded codebook is described hereinafter under the section entitled "Training the Codebooks".

Both the transmitter and the receiver have identical codebooks. The function of split VQ unit 40 is to find, for each critical band, the codevector that best represents the coefficients within that band in view of the number of bits allocated to that band and taking into account the masking threshold.

For each critical band, the MDCT coefficients, $X_k^{(i)}$, are compared to the corresponding (in frequency) codevector elements, $X_k^{(i)}$, to determine the squared difference, $E_k^{(i)}$, between the codevector elements and the MDCT coefficients. The codevector coefficients are stored in a normalized form so it is necessary prior to the comparison to multiply the codevector coefficients by the square root of the quantized spectral energy for that band, $\hat{G}_i$. The squared error is given by:

$$E_k^{(i)}=(X_k^{(i)}-(\hat{G}_i)^{(0.5)}|X_k^{(i)}|)^2$$

($G_i$ and not the more accurate $G_i$ is used in calculating the error $E_{i(I)}$ because the infomation passed to the receiver allows only the recovery of $G_i$ for use in unnormalizing the codevectors; thus the true measure of the error $E_k^{(i)}$ at the receiver is dependent upon $G_i$.)

The normalized masking threshold per coefficient in the linear domain for each critical band, $t_{iu}$ is calculated according to the formula:

$$t_{iu}=(10^{Tiu/10})/L_i$$

The normalized masking threshold per coefficient, $t_{iu}$, is subtracted from the squared error $E_k^{(i)}$. This will provide a measure of the energy of the audible or perceived difference between the codevector representation of the coefficients in the critical band, $X_k^{(i)}$, and the actual coefficients in the critical band, $X_k^{(i)}$. If the difference for any coefficient, $E_k^{(i)}-t_i$ is less than zero (masking threshold greater than the difference between the codevector coefficient and the real coefficient) then the perceived difference arising from that codevector is set to zero when calculating the sum of energy of the perceived differences, $D_i$, for the coefficients for that critical band. This is done because there is no advantage to reducing the difference below the masking threshold, because the codevector representation of that coefficient is already within the dead zone. The audible energy of the perceived differences (i.e. the distortion), $D_i$, for each codevector is given by:

$$D_i=\Sigma\max\,[0, E_k^{(i)}-t_{iu}] \text{ (for all coefficients in the ith critical band)}$$

Where the max function takes the larger value of the two arguments

For each normalized codevector being considered a value for $D_i$ is calculated. The codevector is chosen for which $D_i$ is the minimum value. The index (or address) of that normalized codevector $V_i$ is then concatenated with the chosen indices for the other critical bands to form a bit stream $V_1, V_2, \ldots V_{17}$ for transmission to the receiver.

Figure 6:
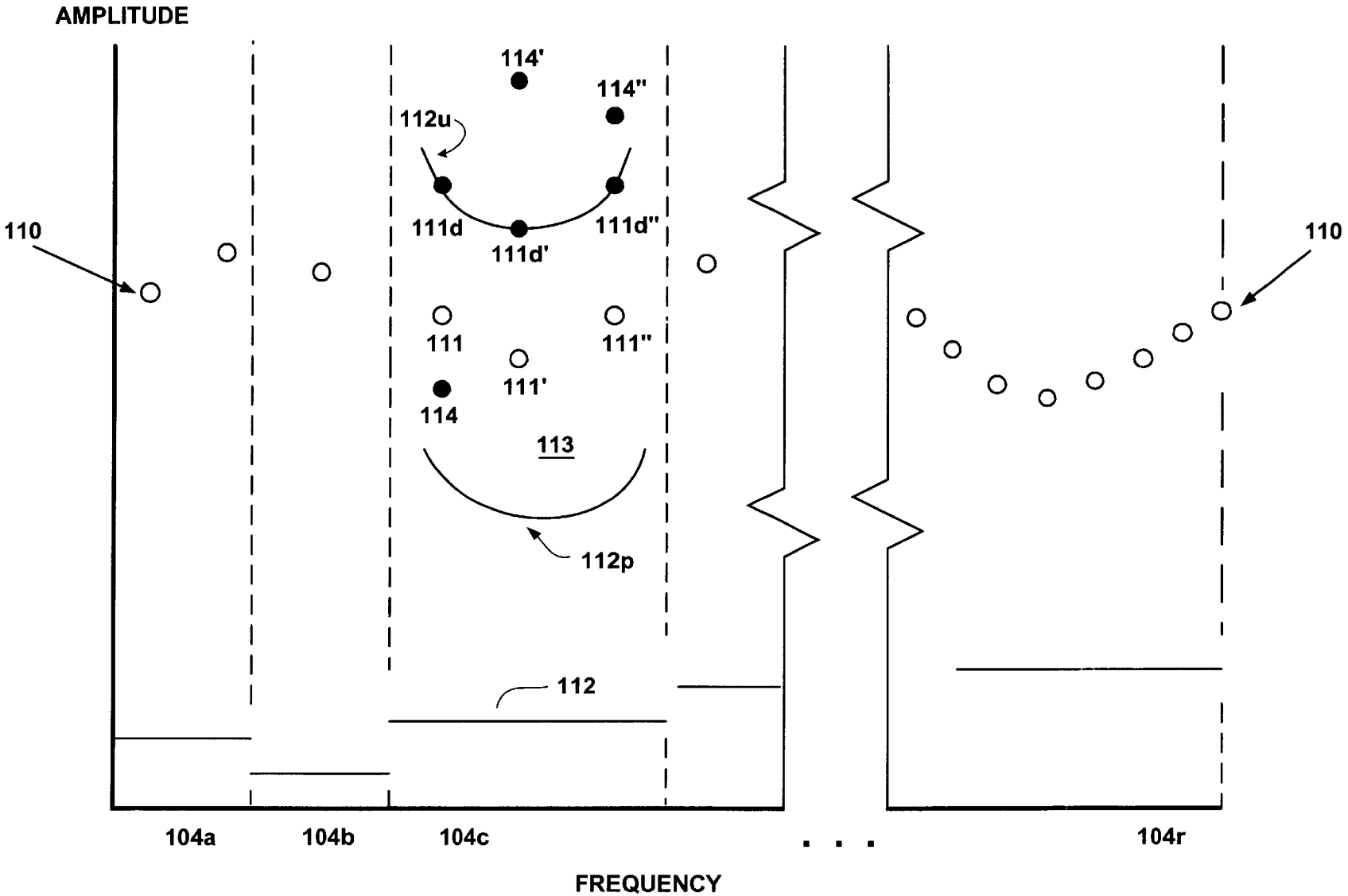
FIG. 6 illustrates, in a graph, MDCT coefficients within critical bands in accordance with an embodiment of the present invention.

The foregoing is graphically illustrated in FIG. 6. Turning to this figure, an input time series frame is first converted to a discrete frequency representation 110 by MDCT calculating unit 28. As illustrated, the 3rd critical band 104*c* is represented by three coefficients 111, 111' and 111". The masking threshold $t_{iu}$ is then calculated for each critical band and is represented by line 112, which is of constant amplitude in each critical band. This masking threshold means that a listener cannot distinguish differences between any sound with a frequency content above or below that of the input signal within a tolerance established by the masking threshold. Thus, for critical band 3, any sound having a frequency content within the deadzone 113 between curves 112*u*, and 112*p* sounds the same to the listener. Thus, sound represented by coefficients 111*d*, 111*d*', 111*d*" would sound the same to a listener as sound represented by coefficients 111, 111" and 111", respectively.

If for this frame two bits are allocated to represent band 3, then one of four codevectors must be chosen to best represent the three MDCT coefficients for band 3. Say one of the four available codevectors in the codebook for band 3 is represented by the elements 114, 114', and 114". The distortion, D, for that codevector is given by the sum of 0 for element 114 since element 114 is within dead zone 113, a value directly proportional to the squared difference in amplitude between 111*d*' and 114' and a value directly proportional to the squared difference in amplitude between 111*d*" and 114". The codevector having the smallest value of D is then chosen to represent critical band 3.

Training the Codebooks

The codebooks for split VQ unit 40 must be populated with codevectors. Populating the codebooks is also known as training the codebooks. The distortion measure described above, $D_i=\Sigma\max\,[0, E_k^{(i)}-t_{iu}]$ (for all coefficients in the ith critical band), can be used advantageously to find codevectors for the codebook using a set of training codevectors. The general methods and approaches to training the codebooks is set out in A. Gersho and R. M. Gray, *Vector Quantization and Signal Compression* (1992, Kluwer Academic Publishers) at 309–368, which is hereby incorporated by reference for all purposes. In training a codebook, the goal is to find codevectors for each critical band that will be most representive of any given MDCT coefficients (i.e. input vector) for the band. The best estimated codevectors are then used to populate the codebook.

The first step in training the codebooks is to produce a large number of training vectors. This is done by taking representative input signals, sampling at the rate and with the frame (window) size used by the transform coder, and generating from these samples sets of MDCT coefficients. For a given input signal, the k MDCT coefficients $X_k^{(i)}$ for the $i^{th}$ critical band are considered to be a training vector for the band. The MDCT coefficients for each input frame are then passed through a coder as described above to calculate masking thresholds, $t_{iu}$, in each critical band for each training vector. Then, for each critical band, the following is undertaken. A distortion measure is calculated for each training vector in the band in the following manner. First an estimate is made of each of the desired normalized (with respect to energy) codevectors for the codebook of the band (each normalized codevector having coefficients, $Xest_k^{(i)}$). Then for each estimated codevector the sum of the audible squared differences is calculated between that codevector and each training vector as follows:

$$E_k^{(i)}=(X_k^{(i)}-G_i^{0.5}Xest_k^{(i)})^2$$

$$D_i=\sum_k \max[0, E_k^{(i)}-t_{iu}]$$

(sum over all coefficients in the $i_{th}$ critical band)

Where $G_i$ is the energy of a subject training vector for the ith critical band; and the max function takes the larger value of the two arguments.

This is exactly the same distortion measure used for coding for transmission except that the estimated codevector is used. Then, by methods known to those skilled in the art, the training vectors are normalized with respect to energy and are used to populate a space whose dimension is the number of coefficients in the critical band. The space is then partitioned into regions, known as Voronoi regions, as follows. Each training vector is associated with the estimated codevector with which it generates the smallest distortion, D. After all training vectors are associated with a codevector, the space comprising associated groups of vectors and the space is partitioned into regions, each comprising one of these associated groups. Each such region is a Voronoi region.

Each estimated codevector is then replaced by the vector at the centroid of its Voronoi region. The number of estimated codevectors in the space (and hence the number of Voronoi regions), is equal to the size of the codebook that is created. The centroid is the vector for which the sum of the distortion between that vector and all training vectors in the region is minimized. In other words, the centroid vector for the $j^{th}$ Voronoi region of the $i^{th}$ band is the vector containing the k coefficients, $Xbest_k^{(i)}$, for which the sum of the audible distortions is minimized: $\{Xbest_k^{(i)}\}$ is that providing $$\min \sum_p \sum_k \max[0, (X_k^{(i)} - (G_i)^{(0.5)} Xbest_k^{(i)})^2 - t_{iu}]$$

where $$\sum_p$$

is a sum over all training vectors in the jth Voronoi region

It should be noted that the centroid coefficients $Xbest_k^{(i)}$ will be approximately normalized with respect to energy but will not be normalized so that the sum of the energies of the coefficients in the codevector does has exactly unit energy.

Next, each training vector is associated with the centroid vector $\{Xbest_k^{(i)}\}$ with which it generates the smallest distortion, D. The space is then partioned into new Voronoi regions, each comprising one of the newly associated group of vectors. Then using these new associated groups of training vectors, the centroid vector is recalculated. This process is repeated until the value of $\{Xbest_k^{(i)}\}$ no longer changes substantially. The final $\{Xbest_k^{(i)}\}$ for each Voronoi region is used as a codevector to populate the codebook.

It should be noted that $\{Xbest_k^{(i)}\}$ must be found through an optimization procedure because the distortion measure, $D_i$, prevents an analytic solution. This differs from the usual Linde-Buzo-Gray (LBG) or Generalized Lloyd Algorithm (GLA) methods of training the codebook based on calculating the least squared error, which are methods known to those skilled in the art.

Embedded Codebooks

In the preferred embodiment, this optimized codebook which spans the frequency spectrum of the $i^{th}$ critical band has $2^{11}$ codevectors. An embedded codebook may be constructed from this $2^{11}$ codebook in the following manner. Using the same techniques as those used in creating an optimized $2^{11}$ codebook, an optimized $2^{10}$ element codebook is found using the training vectors. Then, the codevectors in the optimal $2^{11}$ codebook that are closest to each of the elements in the optimal $2^{10}$ codebook—as determined by least squares measurements—are selected. The $2^{11}$ codebook is then sorted so the $2^{10}$ closest codevectors from the $2^{11}$ codebook are placed at the first half of the $2^{11}$ codebook. Thus, the $2^{10}$ element codebook is now embedded within the $2^{11}$ element codebook. If only 10 bits were available to address the $2^{11}$ codebook only the first $2^{10}$ elements of the codebook would be searched. The codebook has now been sorted so that these $2^{10}$ elements are closest to an optimal $2^{10}$ codebook. To embed a $2^9$ codebook, the above process is repeated. Thus, first an optimal $2^9$ element codebook is found. Then these optimal $2^9$ elements are compared to the $2^{10}$ element codebook embedded in (and sorted to the first half of) the $2^{11}$ codebook. From this set of embedded $2^{10}$ elements, the $2^9$ elements which are the closest match to the optimal $2^9$ codebook elements are selected and placed in the first quarter of the $2^{11}$ codebook. Thus, now both a $2^{10}$ element codebook and a $2^9$ element codebook are embedded in the original $2^{11}$ element codebook. This process can be repeated to embed successively smaller codebooks in the original codebook.

Alternatively, an embedded codebook could be created by starting with the smallest codebook. Thus, in the preferred embodiment, each band has, as its smallest codebook, a 1-bit (2 element) codebook. First an optimal $2^1$ element codebook is designed. Then the 2 elements from this $2^1$ element codebook and 2 additional estimated codevectors are used as the first estimates for a $2^2$ element codebook. These four codevectors are used to partition a space formed by the training vectors into four Voronoi regions. Then the centroids of the Voronoi regions corresponding to the 2 additional estimated codevectors are calculated. The estimate codevectors are then replaced by the centroids of their Voronoi regions (keeping the codevectors from the $2^1$ codevector fixed). Then Voronoi regions are recalculated and new centroids calculated for the regions corresponding to the 2 additional estimated codevectors. This process is repeated until the difference between 2 successive sets of the 2 additional estimated codevectors is small. Then the 2 additional estimated codevectors are used to populate the last 2 places in the $2^2$ element codebook. Now the original $2^1$ element codebook has been embedded within a $2^2$ element codebook. The entire process can be repeated to embed the new codebook with successively larger codebooks.

The remaining codebooks in the transmitter, as well as the prediction matrix M are trained using LBG using a least squares distortion measure.

Windowing

In the preferred embodiment of the invention, a window with a length of 240 time samples is used. It is important to reduce spectral leakage between MDCT coefficients. Reducing the leakage can be achieved by windowing the input frame (applying a series of gain factors) with a suitable non-rectangular function. A gain factor is applied to each sample (0 to 239) in the window. These gain factors are set out in Appendix A. In a more sophisticated embodiment, a short window with a length of 80 samples may also be used whenever a large positive transient is detected. The gain factors applied to each sample of the short window are also set out in Appendix A. Short windows are used for large positive transients and not small negative transients, because with a negative transient, forward temporal masking (post-masking) will occur and errors caused by the transient will be less audible.

The transient is detected in the following manner by window selection unit 42. In the time domain, a very local estimate is made of the energy of the signal, $e_j$. This is done by taking the square of the amplitude of three successive time samples which are passed from input buffer 22 to window selection unit 42. This estimate is calculated for 80 successive groups of three samples in the 240 sample frame:

$$e_j = \Sigma\Sigma(x(i+3j))^2 \text{ (for } j=0 \text{ to } 79, \text{ for } i=0 \text{ to } 2)$$

Where x(I) is the amplitude of the signal at time I

Then the change in $e_j$ between each successive group of three samples is calculated. The maximum change in $e_j$ between the successive groups of three samples in the frame, $e_{jmax}$ is calculated:

$$e_{jmax} = \max[(e_{j+1} - e_j)/e_j)] \text{ (For } j=0 \text{ to } 79)$$

The quantity $e_{jmax}$ is calculated for the frame before the window is selected. If $e_{jmax}$ exceeds a threshold value, which in the preferred embodiment is 5, then a large positive transient has been detected and the next frame moves to a first transitional window with a length of 240 samples. As will be apparent to those skilled in the art, other calculations can be employed to detect a large positive transient. The transitional window applies a series of different gain factors to the samples in the time domain. The gain factors for each sample of the first transitional window is set out in Appendix A. In the next frame $e_{jmax}$ is again calculated for the 240 samples in the time domain. If it remains above the threshold value three short, 80 sample windows are selected. However, if $e_{jmax}$ is below the threshold value a second transitional window is selected for the next frame and then the regular window is used for the frame following the second transitional frame. The gain factors of the second transitional window are also shown in Appendix A. If $e_{jmax}$ is consistently above the threshold, as might occur for certain types of sound such as the sound of certain musical instruments (e.g., the castanet), then short windows will continue to be selected. The truth table showing the rules in the preferred embodiment for switching between windows is shown in FIG. 7.

When a shorter window is used, a number of changes to the functioning of the coder and decoder occur. When the window is 80 samples, 40 current and 40 previous samples are used. MDCT unit 26 generates only 40 MDCT coefficients. Although the number of critical bands remains constant at 17, the distribution of MDCT coefficients within the bands, $L_i$, changes. A different set of 8 prediction matrices $M_m$ will be used to calculate $\{\tilde{O}_{Ni}(m)\}=M_m\cdot\{\hat{O}_{Ni}(n-1))\}$. The total number of bits available for transmitting the split VQ information, $b_d$, is changed from 85 to 25. When short windows are used predictive VQ unit 34 uses a single $2^8$ element codebook to code the residual R' and R'''. As well, $\delta_{(best)}$ is coded in a 3 bit codeword. When short windows are used, non-predictive vector quantization is not used.

When the short windows are used, certain critical bands have only one coefficient. The coefficients for each critical band are shown in FIG. 4. For short windows the 17 critical bands are combined into 7 aggregate bands. This aggregation is performed so that the vector quantization in split VQ unit 40 can always operate on codevectors of dimension greater than one. FIG. 4 also shows how the aggregate bands are formed. Certain changes in the calculations are required when the aggregate bands are used. A single value of O*i* is calculated for each of the aggregate bands. As well, $L_i$ is now used to refer to the number of coefficients in the aggregate band. However the masking threshold is calculated separately for each critical band as the offset $F_i$ and the spreading function can still be calculated directly and more accurately for each critical band.

The different parameters representing the frame, as set out in FIG. 5, are then collected by multiplexer 44 from split VQ unit 40, predictive VQ unit 32 and window selection unit 42. The multiplexed parameters are then transmitted from the transmitter to the receiver.

Receiver

Figure 3:
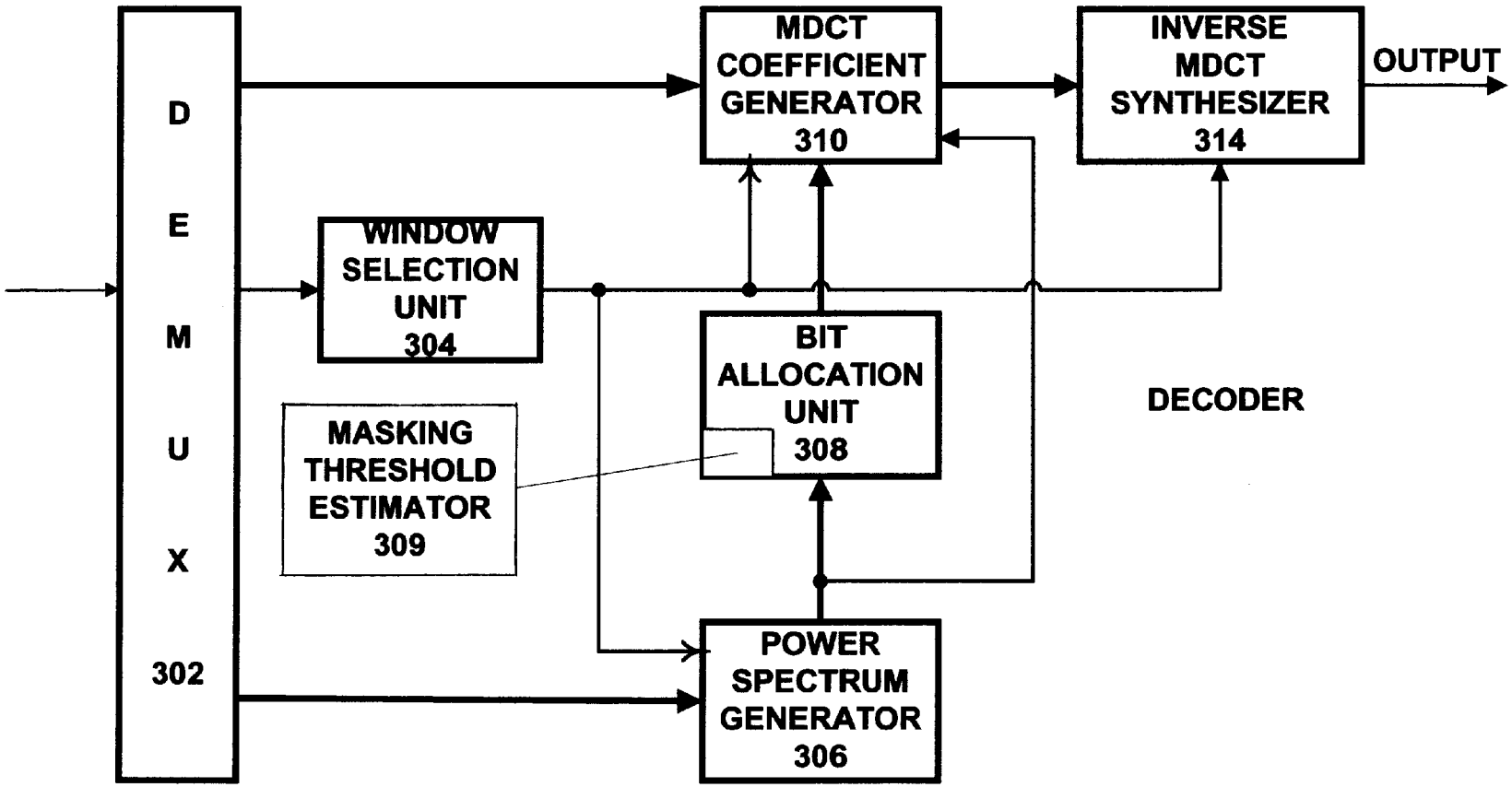
FIG. 3 illustrates, in a block diagram, a receiver in accordance with an embodiment of the present invention.

Referring to FIG. 3, a block diagram is shown illustrating a receiver in accordance with an embodiment of the present invention. Demultiplexer 302 receives and demultiplexes bits that were transmitted by the transmitter. The received bits are passed on to window selection unit 304, power spectrum generator 306, and MDCT coefficient generator 310.

Window selection unit 304 receives a bit which indicates whether the frame is based on short windows or long windows. This bit is passed to power spectrum generator 306, MDCT coefficient generator 310, and inverse MDCT synthesizer 314 so they can select the correct value for $L_i$, $b_d$, and the correct codebooks and predictor matrices.

Power spectrum generator 306 receives the bits encoding the following information: the index for $\delta_{n(best)}$; the index $m_{best}$; $r_{best}$; $s_{best}$; and the bit indicating non-predictive gain quantization. The masking threshold, $T_i$ the quantized spectral energy, $\hat{g}_n$, and the normalized quantized spectral energy, $\hat{O}_{Ni}(n)$, are calculated according to the following equations:

$$\hat{g}_n=\delta_{n(best)}+\alpha\hat{g}_{n-1}$$

$$\{\hat{O}_{Ni}(n)\}=M(m_{best})\cdot\{\tilde{O}_{Ni}(n-1)\}+\{R'_i(r_{best})\}+\{R'''_i(s_{best}\}$$

When non-predictive gain quantization is used:

$$O_{Ni}(n)=R'_i(r_{best})+R'''_i(s_{best})$$

where $r_{best}$ and $s_{best}$ are indices to the $2^{12}$ non-predictive codebooks.

Then:

$$\hat{O}_i(n)=\hat{O}_{Ni}(n)+\hat{g}_n$$

$$\hat{G}_i=10\hat{}(\hat{O}_i(n)/10)$$

Then the parameters for $\hat{G}_i$ are passed to masking threshold estimator 309 and the following calculations are performed:

$$\hat{G}_{Si}=\hat{G}_i{}^*S_{iN}=\Sigma S_{zN}\hat{G}_{i-z}, \text{ for } z=0 \text{ to } L-1$$

$$\hat{O}_{Si}=10\log_{10}\hat{G}_{Si}$$

$$F_i=5.5(1-a)+(14.5+i)a$$

Where $F_i$ is the offset for the ith band; and a is the chosen spectral flatness measure for the frame, which in the preferred embodiment is 0.5.

$$T_i=\hat{O}_{Si}-F_i$$

Next the bit allocation for the frame is determined in bit allocation unit 308. Bit allocation unit 308 receives from power spectrum generator 306 values for the masking threshold, $T_i$, and the unnormalized quantized spectral energy, $\hat{O}_i$. It then calculates the bit allocation $b_i$ in the following manner:

The gap for each band is calculated in bit allocation unit 308 in the following manner:

$$\text{Gap}_i=\hat{O}_i-T_i$$

The first approximation of the number of bits to represent the shape of the frequency spectrum within each critical bands, $b_i$, is calculated.

$$b_i=\lfloor Gap_i\cdot L_i\cdot b_d/(\Sigma\text{Gap}_i\cdot L_i, \text{ for all } i)\rfloor$$

Where $b_d$ is the total number of bits available for transmission between the transmitter and the receiver to represent the shape of the frequency spectrum within the critical bands;

$\lfloor\ldots\rfloor$ represents the floor function which provides that the fractional results of the division are discarded, leaving only the integer result; and Li is the number of coefficients in the ith critical band.

However, as aforenoted, in the preferred embodiment the maximum number of bits that can be allocated to any band is limited to 11. It should be noted that as a result of using the floor function the number of bits allocated in the first approximation will be less than $b_d$ (the total number of bits available for transmission between the transmitter and the receiver to represent the shape of the frequency spectrum within the critical bands). To allocate the remaining bits, a modified gap, $Gap'_i$, is calculated which takes into account the bits allocated in the first approximation $$Gap'_i = \hat{O}_i - T_i - 6 \cdot b_i / L_i$$

The value of $Gap'_i$ is calculated for all critical bands. An additional bit is then allocated to the band with the largest value of $Gap'_i$. The value of $b_i$ for that band is incremented by one, and then $Gap'_i$ is recalculated for all bands. This process is repeated until all remaining bits are allocated. It should be noted that instead of using the formula $b_i = \lfloor Gap_i \cdot L_i \cdot b_d / (\Sigma Gap_i \cdot L_i$, for all i)$\rfloor$ to make a first approximation of bit allocation, $b_i$ could have been set to zero for all bands, and then the bits could be allocated by calculating $Gap'_i$, allocating a bit to the band with the largest value of $Gap'_i$, and then repeating the calculation and allocation until all bits are allocated where this same alternate approach is used in the transmitter.

Bit allocation unit 308 then passes the 17 dimensional $b_i$ vector to MDCT coefficient generator 310. MDCT coefficient generator 310 has also received from power spectrum generator 306 values for the quantized spectral energy $\hat{G}_i$ and from demultiplexer 302 concatenated indexes $V_i$ corresponding to codevectors for the coefficients within the critical bands. The $b_i$ vector allows parsing of the concatenated $V_i$ indices (addresses) into the $V_i$ index for each critical band. Each index is a pointer to a set of normalized coefficients for each particular critical band. These normalized coefficients are then multiplied by the square root of the quantized spectral energy for that band, $\hat{G}_i$. If no bits are allocated to a particular critical band, the coefficients for that band are set to zero.

The unnormalized coefficients are then passed to an inverse MDCT synthesizer 314 where they are arguments to an inverse MDCT function which then synthesizes an output signal in the time domain.

It will be appreciated that transforms other than MDCT transform could be used, such as the discrete Fourier transform. As well, by approximating the shape of the spreading function within each band, a different masking threshold could be calculated for each coefficient.

Other modifications will be apparent to those skilled in the art and, therefore, the invention is defined in the claims.

APPENDIX "A"

| INDEX | VALUE |
|---|---|
| REGULAR WINDOW | |
| 0 | 0.1154 |
| 1 | 0.1218 |
| 2 | 0.1283 |
| 3 | 0.1350 |
| 4 | 0.1419 |
| 5 | 0.1488 |
| 6 | 0.1560 |
| 7 | 0.1633 |
| 8 | 0.1708 |
| 9 | 0.1785 |
| 10 | 0.1863 |
| 11 | 0.1943 |
| 12 | 0.2024 |
| 13 | 0.2107 |
| 14 | 0.2191 |
| 15 | 0.2277 |
| 16 | 0.2364 |
| 17 | 0.2453 |
| 18 | 0.2544 |

-continued

APPENDIX "A"

| INDEX | VALUE |
|---|---|
| 19 | 0.2636 |
| 20 | 0.2730 |
| 21 | 0.2825 |
| 22 | 0.2922 |
| 23 | 0.3019 |
| 24 | 0.3119 |
| 25 | 0.3220 |
| 26 | 0.3322 |
| 27 | 0.3427 |
| 28 | 0.3531 |
| 29 | 0.3637 |
| 30 | 0.3744 |
| 31 | 0.3853 |
| 32 | 0.3962 |
| 33 | 0.4072 |
| 34 | 0.4184 |
| 35 | 0.4296 |
| 36 | 0.4408 |
| 37 | 0.4522 |
| 38 | 0.4637 |
| 39 | 0.4751 |
| 40 | 0.4867 |
| 41 | 0.4982 |
| 42 | 0.5099 |
| 43 | 0.5215 |
| 44 | 0.5331 |
| 45 | 0.5447 |
| 46 | 0.5564 |
| 47 | 0.5679 |
| 48 | 0.5795 |
| 49 | 0.5910 |
| 50 | 0.6026 |
| 51 | 0.6140 |
| 52 | 0.6253 |
| 53 | 0.6366 |
| 54 | 0.6477 |
| 55 | 0.6588 |
| 56 | 0.6698 |
| 57 | 0.6806 |
| 58 | 0.6913 |
| 59 | 0.7019 |
| 60 | 0.7123 |
| 61 | 0.7226 |
| 62 | 0.7326 |
| 63 | 0.7426 |
| 64 | 0.7523 |
| 65 | 0.7619 |
| 66 | 0.7712 |
| 67 | 0.7804 |
| 68 | 0.7893 |
| 69 | 0.7981 |
| 70 | 0.8066 |
| 71 | 0.8150 |
| 72 | 0.8231 |
| 73 | 0.8309 |
| 74 | 0.8386 |
| 75 | 0.8461 |
| 76 | 0.8533 |
| 77 | 0.8602 |
| 78 | 0.8670 |
| 79 | 0.8736 |
| 80 | 0.8799 |
| 81 | 0.8860 |
| 82 | 0.8919 |
| 83 | 0.8976 |
| 84 | 0.9030 |
| 85 | 0.9083 |
| 86 | 0.9133 |
| 87 | 0.9182 |
| 88 | 0.9228 |
| 89 | 0.9273 |
| 90 | 0.9315 |
| 91 | 0.9356 |
| 92 | 0.9395 |
| 93 | 0.9432 |

-continued

APPENDIX "A"

| INDEX | VALUE |
|---|---|
| 94 | 0.9467 |
| 95 | 0.9501 |
| 96 | 0.9533 |
| 97 | 0.9564 |
| 98 | 0.9593 |
| 99 | 0.9620 |
| 100 | 0.9646 |
| 101 | 0.9671 |
| 102 | 0.9694 |
| 103 | 0.9716 |
| 104 | 0.9737 |
| 105 | 0.9757 |
| 106 | 0.9776 |
| 107 | 0.9793 |
| 108 | 0.9809 |
| 109 | 0.9825 |
| 110 | 0.9839 |
| 111 | 0.9853 |
| 112 | 0.9866 |
| 113 | 0.9878 |
| 114 | 0.9889 |
| 115 | 0.9899 |
| 116 | 0.9908 |
| 117 | 0.9917 |
| 118 | 0.9926 |
| 119 | 0.9933 |
| 120 | 0.9933 |
| 121 | 0.9926 |
| 122 | 0.9917 |
| 123 | 0.9908 |
| 124 | 0.9899 |
| 125 | 0.9889 |
| 126 | 0.9878 |
| 127 | 0.9866 |
| 128 | 0.9853 |
| 129 | 0.9839 |
| 130 | 0.9825 |
| 131 | 0.9809 |
| 132 | 0.9793 |
| 133 | 0.9776 |
| 134 | 0.9757 |
| 135 | 0.9737 |
| 136 | 0.9716 |
| 137 | 0.9694 |
| 138 | 0.9671 |
| 139 | 0.9646 |
| 140 | 0.9620 |
| 141 | 0.9593 |
| 142 | 0.9564 |
| 143 | 0.9533 |
| 144 | 0.9501 |
| 145 | 0.9467 |
| 146 | 0.9432 |
| 147 | 0.9395 |
| 148 | 0.9356 |
| 149 | 0.9315 |
| 150 | 0.9273 |
| 151 | 0.9228 |
| 152 | 0.9182 |
| 153 | 0.9133 |
| 154 | 0.9083 |
| 155 | 0.9030 |
| 156 | 0.8976 |
| 157 | 0.8919 |
| 158 | 0.8860 |
| 159 | 0.8799 |
| 160 | 0.8736 |
| 161 | 0.8670 |
| 162 | 0.8602 |
| 163 | 0.8533 |
| 164 | 0.8461 |
| 165 | 0.8386 |
| 166 | 0.8309 |

-continued

APPENDIX "A"

| INDEX | VALUE |
|---|---|
| 167 | 0.8231 |
| 168 | 0.8150 |
| 169 | 0.8066 |
| 170 | 0.7981 |
| 171 | 0.7893 |
| 172 | 0.7804 |
| 173 | 0.7712 |
| 174 | 0.7619 |
| 175 | 0.7523 |
| 176 | 0.7426 |
| 177 | 0.7326 |
| 178 | 0.7226 |
| 179 | 0.7123 |
| 180 | 0.7019 |
| 181 | 0.6913 |
| 182 | 0.6806 |
| 183 | 0.6698 |
| 184 | 0.6588 |
| 185 | 0.6477 |
| 186 | 0.6366 |
| 187 | 0.6253 |
| 188 | 0.6140 |
| 189 | 0.6026 |
| 190 | 0.5910 |
| 191 | 0.5795 |
| 192 | 0.5679 |
| 193 | 0.5564 |
| 194 | 0.5447 |
| 195 | 0.5331 |
| 196 | 0.5215 |
| 197 | 0.5099 |
| 198 | 0.4982 |
| 199 | 0.4867 |
| 200 | 0.4751 |
| 201 | 0.4637 |
| 202 | 0.4522 |
| 203 | 0.4408 |
| 204 | 0.4296 |
| 205 | 0.4184 |
| 206 | 0.4072 |
| 207 | 0.3962 |
| 208 | 0.3853 |
| 209 | 0.3744 |
| 210 | 0.3637 |
| 211 | 0.3531 |
| 212 | 0.3427 |
| 213 | 0.3322 |
| 214 | 0.3220 |
| 215 | 0.3119 |
| 216 | 0.3019 |
| 217 | 0.2922 |
| 218 | 0.2825 |
| 219 | 0.2730 |
| 220 | 0.2636 |
| 221 | 0.2544 |
| 222 | 0.2453 |
| 223 | 0.2364 |
| 224 | 0.2277 |
| 225 | 0.2191 |
| 226 | 0.2107 |
| 227 | 0.2024 |
| 228 | 0.1943 |
| 229 | 0.1863 |
| 230 | 0.1785 |
| 231 | 0.1708 |
| 232 | 0.1633 |
| 233 | 0.1560 |
| 234 | 0.1488 |
| 235 | 0.1419 |
| 236 | 0.1350 |
| 237 | 0.1283 |
| 238 | 0.1218 |
| 239 | 0.1154 |

-continued

APPENDIX "A"

| INDEX | VALUE |
|---|---|
| SHORT WINDOW | |
| 0 | 0.1177 |
| 1 | 0.1361 |
| 2 | 0.1559 |
| 3 | 0.1772 |
| 4 | 0.2000 |
| 5 | 0.2245 |
| 6 | 0.2505 |
| 7 | 0.2782 |
| 8 | 0.3074 |
| 9 | 0.3381 |
| 10 | 0.3703 |
| 11 | 0.4039 |
| 12 | 0.4385 |
| 13 | 0.4742 |
| 14 | 0.5104 |
| 15 | 0.5471 |
| 16 | 0.5837 |
| 17 | 0.6201 |
| 18 | 0.6557 |
| 19 | 0.6903 |
| 20 | 0.7235 |
| 21 | 0.7550 |
| 22 | 0.7845 |
| 23 | 0.8119 |
| 24 | 0.8371 |
| 25 | 0.8599 |
| 26 | 0.8804 |
| 27 | 0.8987 |
| 28 | 0.9148 |
| 29 | 0.9289 |
| 30 | 0.9411 |
| 31 | 0.9516 |
| 32 | 0.9605 |
| 33 | 0.9681 |
| 34 | 0.9745 |
| 35 | 0.9798 |
| 36 | 0.9842 |
| 37 | 0.9878 |
| 38 | 0.9907 |
| 39 | 0.9930 |
| 40 | 0.9930 |
| 41 | 0.9907 |
| 42 | 0.9878 |
| 43 | 0.9842 |
| 44 | 0.9798 |
| 45 | 0.9745 |
| 46 | 0.9681 |
| 47 | 0.9605 |
| 48 | 0.9516 |
| 49 | 0.9411 |
| 50 | 0.9289 |
| 51 | 0.9148 |
| 52 | 0.8987 |
| 53 | 0.8804 |
| 54 | 0.8599 |
| 55 | 0.8371 |
| 56 | 0.8119 |
| 57 | 0.7845 |
| 58 | 0.7550 |
| 59 | 0.7235 |
| 60 | 0.6903 |
| 61 | 0.6557 |
| 62 | 0.6201 |
| 63 | 0.5837 |
| 64 | 0.5471 |
| 65 | 0.5104 |
| 66 | 0.4742 |
| 67 | 0.4385 |
| 68 | 0.4039 |
| 69 | 0.3703 |
| 70 | 0.3381 |
| 71 | 0.3074 |
| 72 | 0.2782 |

-continued

APPENDIX "A"

| INDEX | VALUE |
|---|---|
| 73 | 0.2505 |
| 74 | 0.2245 |
| 75 | 0.2000 |
| 76 | 0.1772 |
| 77 | 0.1559 |
| 78 | 0.1361 |
| 79 | 0.1177 |
| FIRST TRANSITIONAL WINDOW | |
| 0 | 0.1154 |
| 1 | 0.1218 |
| 2 | 0.1283 |
| 3 | 0.1350 |
| 4 | 0.1419 |
| 5 | 0.1488 |
| 6 | 0.1560 |
| 7 | 0.1633 |
| 8 | 0.1708 |
| 9 | 0.1785 |
| 10 | 0.1863 |
| 11 | 0.1943 |
| 12 | 0.2024 |
| 13 | 0.2107 |
| 14 | 0.2191 |
| 15 | 0.2277 |
| 16 | 0.2364 |
| 17 | 0.2453 |
| 18 | 0.2544 |
| 19 | 0.2636 |
| 20 | 0.2730 |
| 21 | 0.2825 |
| 22 | 0.2922 |
| 23 | 0.3019 |
| 24 | 0.3119 |
| 25 | 0.3220 |
| 26 | 0.3322 |
| 27 | 0.3427 |
| 28 | 0.3531 |
| 29 | 0.3637 |
| 30 | 0.3744 |
| 31 | 0.3853 |
| 32 | 0.3962 |
| 33 | 0.4072 |
| 34 | 0.4184 |
| 35 | 0.4296 |
| 36 | 0.4408 |
| 37 | 0.4522 |
| 38 | 0.4637 |
| 39 | 0.4751 |
| 40 | 0.4867 |
| 41 | 0.4982 |
| 42 | 0.5099 |
| 43 | 0.5215 |
| 44 | 0.5331 |
| 45 | 0.5447 |
| 46 | 0.5564 |
| 47 | 0.5679 |
| 48 | 0.5795 |
| 49 | 0.5910 |
| 50 | 0.6026 |
| 51 | 0.6140 |
| 52 | 0.6253 |
| 53 | 0.6366 |
| 54 | 0.6477 |
| 55 | 0.6588 |
| 56 | 0.6698 |
| 57 | 0.6806 |
| 58 | 0.6913 |
| 59 | 0.7019 |
| 60 | 0.7123 |
| 61 | 0.7226 |
| 62 | 0.7326 |
| 63 | 0.7426 |
| 64 | 0.7523 |
| 65 | 0.7619 |

-continued

APPENDIX "A"

| INDEX | VALUE |
|---|---|
| 66 | 0.7712 |
| 67 | 0.7804 |
| 68 | 0.7893 |
| 69 | 0.7981 |
| 70 | 0.8066 |
| 71 | 0.8150 |
| 72 | 0.8231 |
| 73 | 0.8309 |
| 74 | 0.8386 |
| 75 | 0.8461 |
| 76 | 0.8533 |
| 77 | 0.8602 |
| 78 | 0.8670 |
| 79 | 0.8736 |
| 80 | 0.8799 |
| 81 | 0.8860 |
| 82 | 0.8919 |
| 83 | 0.8976 |
| 84 | 0.9030 |
| 85 | 0.9083 |
| 86 | 0.9133 |
| 87 | 0.9182 |
| 88 | 0.9228 |
| 89 | 0.9273 |
| 90 | 0.9315 |
| 91 | 0.9356 |
| 92 | 0.9395 |
| 93 | 0.9432 |
| 94 | 0.9467 |
| 95 | 0.9501 |
| 96 | 0.9533 |
| 97 | 0.9564 |
| 98 | 0.9593 |
| 99 | 0.9620 |
| 100 | 0.9646 |
| 101 | 0.9671 |
| 102 | 0.9694 |
| 103 | 0.9716 |
| 104 | 0.9737 |
| 105 | 0.9757 |
| 106 | 0.9776 |
| 107 | 0.9793 |
| 108 | 0.9809 |
| 109 | 0.9825 |
| 110 | 0.9839 |
| 111 | 0.9853 |
| 112 | 0.9866 |
| 113 | 0.9878 |
| 114 | 0.9889 |
| 115 | 0.9899 |
| 116 | 0.9908 |
| 117 | 0.9917 |
| 118 | 0.9926 |
| 119 | 0.9933 |
| 120 | 1 |
| 121 | 1 |
| 122 | 1 |
| 123 | 1 |
| 124 | 1 |
| 125 | 1 |
| 126 | 1 |
| 127 | 1 |
| 128 | 1 |
| 129 | 1 |
| 130 | 1 |
| 131 | 1 |
| 132 | 1 |
| 133 | 1 |
| 134 | 1 |
| 135 | 1 |
| 136 | 1 |
| 137 | 1 |
| 138 | 1 |
| 139 | 1 |
| 140 | 1 |

-continued

APPENDIX "A"

| INDEX | VALUE |
|---|---|
| 141 | 1 |
| 142 | 1 |
| 143 | 1 |
| 144 | 1 |
| 145 | 1 |
| 146 | 1 |
| 147 | 1 |
| 148 | 1 |
| 149 | 1 |
| 150 | 1 |
| 151 | 1 |
| 152 | 1 |
| 153 | 1 |
| 154 | 1 |
| 155 | 1 |
| 156 | 1 |
| 157 | 1 |
| 158 | 1 |
| 159 | 1 |
| 160 | 0.9930 |
| 161 | 0.9907 |
| 162 | 0.9878 |
| 163 | 0.9842 |
| 164 | 0.9798 |
| 165 | 0.9745 |
| 166 | 0.9681 |
| 167 | 0.9605 |
| 168 | 0.9516 |
| 169 | 0.9411 |
| 170 | 0.9289 |
| 171 | 0.9148 |
| 172 | 0.8987 |
| 173 | 0.8804 |
| 174 | 0.8599 |
| 175 | 0.8371 |
| 176 | 0.8119 |
| 177 | 0.7845 |
| 178 | 0.7550 |
| 179 | 0.7235 |
| 180 | 0.6903 |
| 181 | 0.6557 |
| 182 | 0.6201 |
| 183 | 0.5837 |
| 184 | 0.5471 |
| 185 | 0.5104 |
| 186 | 0.4742 |
| 187 | 0.4385 |
| 188 | 0.4039 |
| 189 | 0.3703 |
| 190 | 0.3381 |
| 191 | 0.3074 |
| 192 | 0.2782 |
| 193 | 0.2505 |
| 194 | 0.2245 |
| 195 | 0.2000 |
| 196 | 0.1772 |
| 197 | 0.1559 |
| 198 | 0.1361 |
| 199 | 0.1177 |
| 200 | 0 |
| 201 | 0 |
| 202 | 0 |
| 203 | 0 |
| 204 | 0 |
| 205 | 0 |
| 206 | 0 |
| 207 | 0 |
| 208 | 0 |
| 209 | 0 |
| 210 | 0 |
| 211 | 0 |
| 212 | 0 |
| 213 | 0 |
| 214 | 0 |
| 215 | 0 |

-continued

APPENDIX "A"

| INDEX | VALUE |
|---|---|
| 216 | 0 |
| 217 | 0 |
| 218 | 0 |
| 219 | 0 |
| 220 | 0 |
| 221 | 0 |
| 222 | 0 |
| 223 | 0 |
| 224 | 0 |
| 225 | 0 |
| 226 | 0 |
| 227 | 0 |
| 228 | 0 |
| 229 | 0 |
| 230 | 0 |
| 231 | 0 |
| 232 | 0 |
| 233 | 0 |
| 234 | 0 |
| 235 | 0 |
| 236 | 0 |
| 237 | 0 |
| 238 | 0 |
| 239 | 0 |
| SECOND TRANSITIONAL WINDOW | |
| 0 | 0 |
| 1 | 0 |
| 2 | 0 |
| 3 | 0 |
| 4 | 0 |
| 5 | 0 |
| 6 | 0 |
| 7 | 0 |
| 8 | 0 |
| 9 | 0 |
| 10 | 0 |
| 11 | 0 |
| 12 | 0 |
| 13 | 0 |
| 14 | 0 |
| 15 | 0 |
| 16 | 0 |
| 17 | 0 |
| 18 | 0 |
| 19 | 0 |
| 20 | 0 |
| 21 | 0 |
| 22 | 0 |
| 23 | 0 |
| 24 | 0 |
| 25 | 0 |
| 26 | 0 |
| 27 | 0 |
| 28 | 0 |
| 29 | 0 |
| 30 | 0 |
| 31 | 0 |
| 32 | 0 |
| 33 | 0 |
| 34 | 0 |
| 35 | 0 |
| 36 | 0 |
| 37 | 0 |
| 38 | 0 |
| 39 | 0 |
| 40 | 0.1177 |
| 41 | 0.1361 |
| 42 | 0.1559 |
| 43 | 0.1772 |
| 44 | 0.2000 |
| 45 | 0.2245 |
| 46 | 0.2505 |
| 47 | 0.2782 |
| 48 | 0.3074 |

-continued

APPENDIX "A"

| INDEX | VALUE |
|---|---|
| 49 | 0.3381 |
| 50 | 0.3703 |
| 51 | 0.4039 |
| 52 | 0.4385 |
| 53 | 0.4742 |
| 54 | 0.5104 |
| 55 | 0.5471 |
| 56 | 0.5837 |
| 57 | 0.6201 |
| 58 | 0.6557 |
| 59 | 0.6903 |
| 60 | 0.7235 |
| 61 | 0.7550 |
| 62 | 0.7845 |
| 63 | 0.8119 |
| 64 | 0.8371 |
| 65 | 0.8599 |
| 66 | 0.8804 |
| 67 | 0.8987 |
| 68 | 0.9148 |
| 69 | 0.9289 |
| 70 | 0.9411 |
| 71 | 0.9516 |
| 72 | 0.9605 |
| 73 | 0.9681 |
| 74 | 0.9745 |
| 75 | 0.9798 |
| 76 | 0.9842 |
| 77 | 0.9878 |
| 78 | 0.9907 |
| 79 | 0.9930 |
| 80 | 1 |
| 81 | 1 |
| 82 | 1 |
| 83 | 1 |
| 84 | 1 |
| 85 | 1 |
| 86 | 1 |
| 87 | 1 |
| 88 | 1 |
| 89 | 1 |
| 90 | 1 |
| 91 | 1 |
| 92 | 1 |
| 93 | 1 |
| 94 | 1 |
| 95 | 1 |
| 96 | 1 |
| 97 | 1 |
| 98 | 1 |
| 99 | 1 |
| 100 | 1 |
| 101 | 1 |
| 102 | 1 |
| 103 | 1 |
| 104 | 1 |
| 105 | 1 |
| 106 | 1 |
| 107 | 1 |
| 108 | 1 |
| 109 | 1 |
| 110 | 1 |
| 111 | 1 |
| 112 | 1 |
| 113 | 1 |
| 114 | 1 |
| 115 | 1 |
| 116 | 1 |
| 117 | 1 |
| 118 | 1 |
| 119 | 1 |
| 120 | 0.9933 |
| 121 | 0.9926 |
| 122 | 0.9917 |
| 123 | 0.9908 |

-continued

APPENDIX "A"

| INDEX | VALUE |
|---|---|
| 124 | 0.9899 |
| 125 | 0.9889 |
| 126 | 0.9878 |
| 127 | 0.9866 |
| 128 | 0.9853 |
| 129 | 0.9839 |
| 130 | 0.9825 |
| 131 | 0.9809 |
| 132 | 0.9793 |
| 133 | 0.9776 |
| 134 | 0.9757 |
| 135 | 0.9737 |
| 136 | 0.9716 |
| 137 | 0.9694 |
| 138 | 0.9671 |
| 139 | 0.9646 |
| 140 | 0.9620 |
| 141 | 0.9593 |
| 142 | 0.9564 |
| 143 | 0.9533 |
| 144 | 0.9501 |
| 145 | 0.9467 |
| 146 | 0.9432 |
| 147 | 0.9395 |
| 148 | 0.9356 |
| 149 | 0.9315 |
| 150 | 0.9273 |
| 151 | 0.9228 |
| 152 | 0.9182 |
| 153 | 0.9133 |
| 154 | 0.9083 |
| 155 | 0.9030 |
| 156 | 0.8976 |
| 157 | 0.8919 |
| 158 | 0.8860 |
| 159 | 0.8799 |
| 160 | 0.8736 |
| 161 | 0.8670 |
| 162 | 0.8602 |
| 163 | 0.8533 |
| 164 | 0.8461 |
| 165 | 0.8386 |
| 166 | 0.8309 |
| 167 | 0.8231 |
| 168 | 0.8150 |
| 169 | 0.8066 |
| 170 | 0.7981 |
| 171 | 0.7893 |
| 172 | 0.7804 |
| 173 | 0.7712 |
| 174 | 0.7619 |
| 175 | 0.7523 |
| 176 | 0.7426 |
| 177 | 0.7326 |
| 178 | 0.7226 |
| 179 | 0.7123 |
| 180 | 0.7019 |
| 181 | 0.6913 |
| 182 | 0.6806 |
| 183 | 0.6698 |
| 184 | 0.6588 |
| 185 | 0.6477 |
| 186 | 0.6366 |
| 187 | 0.6253 |
| 188 | 0.6140 |
| 189 | 0.6026 |
| 190 | 0.5910 |
| 191 | 0.5795 |
| 192 | 0.5679 |
| 193 | 0.5564 |
| 194 | 0.5447 |
| 195 | 0.5331 |
| 196 | 0.5215 |
| 197 | 0.5099 |
| 198 | 0.4982 |

-continued

APPENDIX "A"

| INDEX | VALUE |
|---|---|
| 199 | 0.4867 |
| 200 | 0.4751 |
| 201 | 0.4637 |
| 202 | 0.4522 |
| 203 | 0.4408 |
| 204 | 0.4296 |
| 205 | 0.4184 |
| 206 | 0.4072 |
| 207 | 0.3962 |
| 208 | 0.3853 |
| 209 | 0.3744 |
| 210 | 0.3637 |
| 211 | 0.3531 |
| 212 | 0.3427 |
| 213 | 0.3322 |
| 214 | 0.3220 |
| 215 | 0.3119 |
| 216 | 0.3019 |
| 217 | 0.2922 |
| 218 | 0.2825 |
| 219 | 0.2730 |
| 220 | 0.2636 |
| 221 | 0.2544 |
| 222 | 0.2453 |
| 223 | 0.2364 |
| 224 | 0.2277 |
| 225 | 0.2191 |
| 226 | 0.2107 |
| 227 | 0.2024 |
| 228 | 0.1943 |
| 229 | 0.1863 |
| 230 | 0.1785 |
| 231 | 0.1708 |
| 232 | 0.1633 |
| 233 | 0.1560 |
| 234 | 0.1488 |
| 235 | 0.1419 |
| 236 | 0.1350 |
| 237 | 0.1283 |
| 238 | 0.1218 |
| 239 | 0.1154 |

What is claimed is:

1. A method of transmitting a discretely represented frequency signal within a frequency band, said signal discretely represented by coefficients at certain frequencies within said band, comprising:

(a) providing a codebook of codevectors for said band, each codevector having an element for each of said certain frequencies;

(b) obtaining a masking threshold for said frequency signal;

(c) for each one of a plurality of codevectors in said codebook, obtaining a distortion measure by:

for each of said coefficients of said frequency signal (i) obtaining a representation of a difference between a corresponding element of said one codevector and (ii) reducing said difference by said masking threshold to obtain an indicator measure; summing those obtained indicator measures which are positive to obtain said distortion measure;

(d) selecting a codevector having a smallest distortion measure;

(e) transmitting an index to said selected codevector.

2. The method of claim 1 wherein said codevectors are normalised with respect to energy and wherein said obtaining a representation of a difference between a given coefficient of said frequency signal and a corresponding element of said one codevector comprises obtaining a squared difference between said given coefficient and said corresponding element after unnormalising said corresponding element with a measure of energy in said signal and including:

(f) transmitting an indication of energy in said signal.

3. The method of claim 2 wherein said obtaining a masking threshold comprises convolving a measure of energy in said signal with a known spreading function.

4. The method of claim 3 wherein said obtaining a masking threshold further comprises adjusting said convolution by an offset dependent upon a spectral flatness measure comprising an arithmetic mean of said coefficients.

5. A method of transmitting a discretely represented frequency signal, said signal discretely represented by coefficients at certain frequencies, comprising:

(a) grouping said coefficients into frequency bands;

(b) for each band of said plurality of frequency bands;

providing a codebook of codevectors, each codevector having an element corresponding with each coefficient within said each band;

obtaining a representation of energy of coefficients in said each band;

selecting a set of addresses which address at least a portion of said codebook such that a size of said address set is directly proportional to energy of coefficients in said each band indicated by said representation of energy;

selecting a codevector from said codebook from amongst those addressable by said address set to represent said coefficients for said band and obtaining an address to said selected codevector;

(d) concatenating each said address obtained for each said codevector selected for said each band to produce concatenated codevector addresses; and (e) transmitting said concatenated codevector addresses and an indication of each said representation of energy.

6. A method of transmitting a discretely represented frequency signal, said signal discretely represented by coefficients at certain frequencies, comprising:

(a) grouping said coefficients into a plurality of frequency bands;

(b) for each band of said plurality of frequency bands:

providing a codebook of codevectors, each codevector having an element corresponding with each coefficient within said each band, each codevector having an address within said codebook;

obtaining a representation of energy of coefficients in said each band;

obtaining a representation of a masking threshold for each said band from said representation of energy;

selecting a set of addresses addressing a plurality of codevectors within said codebook such that said size of said set of addresses is directly proportional to a modified representation of energy of coefficients in said each band as determined by reducing said representation of energy by a masking threshold indicated by said representation of a masking threshold;

selecting a codevector, from said codebook from amongst those addressable by said set of addresses, to represent said coefficients for said each band and obtaining an index to said selected codevector;

(d) concatenating each said index obtained for each said codevector selected for said each band to produce concatenated codevector indices; and (e) transmitting said concatenated codevector indices and an indication of each said representation of energy.

7. The method of claim 6 wherein said representation of a masking threshold is obtained from a convolution of said representation of energy with a pre-defined spreading function.

8. The method of claim 7 wherein said representation of a masking threshold is reduced by an offset dependent upon a spectral flatness measure chosen as a constant.

9. The method of claim 6 wherein any band having an identical number of coefficients as another band shares a codebook with said other band.

10. The method of claim 6 wherein said selecting a codevector to represent said coefficients for said each band comprises:

for each one codevector of said plurality of codevectors addressed by said set of addresses:

for each coefficient of said coefficients of said each band:

(i) obtaining a difference between said each coefficient and a corresponding element of said one codevector; and (ii) reducing said difference by said masking threshold indicated by said representation of a masking threshold to obtain an indicator measure;

summing those obtained indicator measures which are positive to obtain a distortion measure;

selecting a codevector having a smallest distortion measure.

11. The method of claim 10 wherein said codevectors are normalised with respect to energy and wherein obtaining said difference between said each coefficient and said corresponding element of said one codevector comprises obtaining a squared difference between said each coefficient and said corresponding element after unnormalising said corresponding element with said representation of energy.

12. The method of claim 6 wherein each said codebook is sorted so as to provide sets of codevectors addressed by corresponding sets of addresses such that each larger set of addresses addresses a larger set of codevectors which span a frequency spectrum of said each band with increasingly less granularity.

13. A method of transmitting a discretely represented time series comprising:

obtaining a Same of time samples;

obtaining a discrete frequency representation of said frame of time samples, said frequency representation comprising coefficients at certain frequencies;

grouping said coefficients into a plurality of frequency bands;

for each band of said plurality of frequency bands:

(i) providing a codebook of codevectors, each codevector having an element corresponding with each coefficient within said each band;

(ii) obtaining a representation of energy of coefficients in said each band;

(iii) selecting a set of addresses which address at least a portion of said codebook such that a size of said set of addresses is directly proportional to energy of coefficients in said each band indicated by said representation of energy;

(iv) selecting a codevector from said codebook from amongst those addressable by said address set to represent said coefficients for said band and obtaining a address to said selected codevector;

concatenating each said address obtained for each said codevector selected for said each band to produce concatenated codevector addresses; and transmitting said concatenated codevector addresses and an indication of each said representation of energy.

14. A method of transmitting a discretely represented time series comprising:

obtaining a frame of time samples; obtaining a discrete frequency representation of said frame of time samples, said frequency representation including coefficients at certain frequencies;

grouping said coefficients into a plurality of frequency bands;

for each band in said plurality of frequency bands:

(i) providing a codebook of codevectors, each codevector having an element corresponding with each coefficient within said each band, each codevector having an address within said codebook;

(ii) obtaining a representation of energy of coefficients in said each band;

(iii) obtaining a representation of a masking threshold for each said band from said representation of energy;

(iv) selecting a set of addresses addressing a plurality of codevectors within said codebook such that said size of said set of addresses is directly proportional to a modified representation of energy of coefficients in said each band as determined by reducing said representation of energy by a masking threshold indicated by said representation of a masking threshold;

(v) selecting a codevector, from said codebook from amongst those addressable by said set of addresses, to represent said coefficients for said each band and obtain an address to said selected codevector;

concatenating each said address obtained for each said codevector selected for said each band to produce concatenated codevector addresses; and transmitting said concatenated codevector addresses and an indication of each said representation of energy.

15. The method of claim 14 wherein said obtaining a representation of energy of coefficients in said each band comprises:

determining an indication of energy for said band;

determining an average energy for said band;

quantising said average energy by finding an entry in an average energy codebook which, when adjusted with a representation of average energy from a frequency representation for a previous fame, best approximates said average energy;

normalising said energy indication with respect to said quantised approximation of said average energy;

quantsing said normalised energy indication by manipulating a normalised energy indication from a frequency representation for said previous frame with each of a number of prediction matrices and selecting a prediction matrix resulting in a quantised normalised energy indication which best approximates said normalised energy indication; and obtaining said representation of energy from said quantised normalised energy.

16. The method of claim 14 including:

obtaining an index to said entry in said average energy codebook;

obtaining an index to said selected prediction matrix;

and wherein said transmitting said concatenated codevector addresses and an indication of each said representation of energy comprises:

transmitting said average energy codebook index; and transmitting said selected prediction matrix index.

17. The method of claim 16 including the:

obtaining an actual residual from a difference between said quantised normalised energy indication and said normalised energy indication;

comparing said actual residual to a residual codebook to find a quantised residual which is a best approximation said actual residual;

adjusting said quantised normalised energy with said quantised residual;

and wherein said obtaining said representation of energy comprises obtaining said representation of energy from said a combination of said quantised normalised energy and said quantised residual.

18. The method of claim 17 including:

obtaining an actual second residual from a difference between (i) said combination of said quantised normalised energy and said quantised residual and (ii) said normalised energy indication;

comparing said actual second residual to a second residual codebook to find a quantised second residual which is a best approximation of said actual second residual;

adjusting said combination with said quantised second residual to obtain a firer combination;

and wherein said obtaining said representation of energy comprises obtaining said representation of energy from said further combination.

19. The method of clam 18 including obtaining an index to said quantised residual in said residual codebook and an index to said quantised second residual in said second residual codebook;

and wherein said transmitting said concatenated codevector addresses and an indication of each said representation of energy composes transmitting said quantised residual index and said quantised second residual index.

20. The method of claim 19 wherein said obtaining a representation of energy comprises unnormalising said further combination with said quantised average energy.

21. The method of claim 20 wherein said representation of a masking threshold is obtained from a convolution of said representation of energy with a pre-defined spreading function.

22. The method of claim 21 wherein said representation of a masking threshold is reduced by an offset dependent upon a spectral flatness measure chosen as a constant.

23. The method of claim 20 wherein any band having an identical number of coefficients as another band shares a codebook with said other band.

24. The method of claim 20 wherein said selecting a codevector to represent said coefficients for said each band comprises:

for each one codevector of said plurality of codevectors addressed by said set of addresses:

for each coefficient of said coefficients of said each band:

(i) obtaining a representation of a difference between said each coefficient and a corresponding element of said one codevector; and (ii) reducing said difference by said masking threshold indicated by said representation of a masking threshold to obtain an indicator measure;

summing those obtained indicator measures which are positive to obtain a distortion measure;

selecting a codevector having a smallest distortion measure.

25. The method of claim 24 wherein said codevectors are normalised with respect to energy and wherein obtaining said difference between said each coefficient and said corresponding element of said one codevector comprises obtaining a squared difference between said each coefficient and said corresponding element after unnormalising said corresponding element with said representation of energy.

26. A method of receiving a discretely represented frequency signal, said signal discretely represented by coefficients at certain frequencies, comprising:

providing pre-defined frequency bands;

for each band of said predefined frequency bands, providing a codebook of codevectors, each codevector having an element corresponding with each of said certain frequencies which are within said each band;

receiving concatenated codevector addresses for said predefined frequency bands and a per band indication of a representation of energy of coefficients in said each band;

determining a length of address for said each band based on said per band indication of a representation of energy;

parsing said concatenated codevector addresses based on said length of address to obtain a parsed codebook address;

addressing said codebook for said each band with said parsed codebook address to obtain frequency coefficients for each said band.

27. A transmitter comprising:

means for obtaining a frame of time samples;

means for obtaining a discrete frequency representation of said frame of time samples, said frequency representation comprising coefficients at certain frequencies;

means for grouping said coefficients into a plurality of frequency bands;

means for, for each band of said plurality of frequency bands:

(i) providing a codebook of codevectors, each codevector having an element corresponding with each coefficient within said each band, each codevector having an address within said codebook;

(ii) obtaining a representation of energy of coefficients in said each band;

(iii) selecting a set of addresses which address at least a portion of said codebook such that a size of said set of addresses is directly proportional to energy of coefficients in said each band indicated by said representation of energy;

(iv) selecting a codevector from said codebook from amongst those addressable by said set of addresses to represent said coefficients for said each band and obtaining an address to said selected codevector;

means for concatenating each said address obtained for each said codevector selected for said each band to produce concatenated codevector addresses; and means for transmitting said concatenated codevector addresses and an indication of each said representation of energy.

28. A receiver comprising:

means for providing a plural of pre-defined frequency bands;

a memory storing, for each band of said plurality of predefined frequency bands, a codebook of codevectors, each codevector having an element corresponding with each of said certain frequencies which are within said each band, each codevector having an address within said codebook;

means for receiving concatenated codevector addresses for said plurality of pre-defined frequency bands and a per band indication of a representation of energy of coefficients in said each band;

means for determining a length of address for said each band based on said per band indication of a representation of energy;

means for parsing said concatenated codevector addresses based on said length of address to obtain a parsed codebook address;

means for addressing said codebook for said each band with said parsed codebook address to obtain frequency coefficients for each said band.

29. A method of obtaining a codebook of codevectors which span a frequency band discretely represented at predefined frequencies, comprising:

receiving training vectors for said frequency band;

receiving an initial set of estimated codevectors;

associating each training vector with a one of said estimated codevectors with respect to which it generates a smallest distortion measure to obtain associated groups of vectors;

partitioning said associated groups of vectors into Voronoi regions;

determining a centroid for each Voronoi region;

selecting each centroid vector as a new estimated codevector;

repeating from said associating until a difference between new estimated codevectors and estimated codevectors from a previous iteration is less than a pre-defined threshold; and populating said codebook with said estimated codevectors resulting after a last iteration.

30. The method of claim 29 wherein each distortion measure is obtained by:

for each element of said training vector (i) obtaining a representation of a difference between a corresponding element of said one estimated codevector and (ii) reducing said difference by a masking threshold of said training vector to obtain an indicator measure;

summing those obtained indicator measures which are positive to obtain said distortion measure.

31. The method of claim 30 wherein said masking threshold is obtained by convolving a measure of energy in said training vector with a known spreading function.

32. The method of claim 31 wherein said masking threshold is obtained by adjusting said convolution by an offset dependent upon a spectral flatness measure comprising an arithmetic mean of said coefficients.

33. The method of claim 32 wherein said estimated codevectors are normalised with respect to energy and wherein obtaining a representation of a difference between a given element of said training vector and a corresponding element of said one estimated codevector comprises obtaining a squared difference between said given element and said corresponding element after unnormalising said corresponding element with a measure of energy in said training vector.

34. The method of claim 33 wherein said determining a centroid for a Voronoi region comprises finding a candidate vector within said region which generates a minimum value for a sum of distortion measures between said candidate vector and each training vector in said region.

35. The method of claim 34 wherein each distortion measure in said sum of distortion measures is obtained by;

for each training vector, for each element of said each training vector (i) obtaining a representation of a difference between a corresponding element of said candidate vector and (ii) reducing said difference by a masking sold for said training vector to obtain an indicator measure;

summing those obtained indicator measures which are positive to obtain said distortion measure.

36. The method of claim 29 wherein said estimated codevectors with which said codebook is populated is a first set of codevectors and wherein said codebook is enlarged by:

fixing said first set of estimated codevectors;

receiving an initial second set of estimated codevectors;

associating each training vector with one estimated codevector from said first set or said second set with respect to which it generates a smallest distortion measure to obtain associated groups of vectors;

partitioning said associated groups of vectors into Voronoi regions;

determining a centroid for Voronoi region containing an estimated codevector from said second set;

selecting each centroid vector as a new estimated second set codevector;

repeating from said associating until a difference between new estimated second set codevectors and estimated second set codevectors from a previous iteration is less than a pre-defined threshold; and populating said codebook with said estimated second set codevectors resulting after a last iteration.

37. The method of claim 36 including sorting said second set estimated codevectors to an end of said codebook whereby to obtain an embedded codebook.

* * * * *

UNITED STATES PATENT AND TRADEMARK OFFICE

CERTIFICATE OF CORRECTION

PATENT NO. : 6,704,705 B1
DATED : March 9, 2004
INVENTOR(S) : Kabal et al.

It is certified that error appears in the above-identified patent and that said Letters Patent is hereby corrected as shown below:

Column 32,
Line 44, the words "obtaining a Same of time samples" are used instead of -- obtaining a frame of time samples --
Line 62, the words "a address" are used instead of -- an address --

Column 33,
Line 30, the words "obtain an address" are used instead of -- obtaining an address --
Line 44, the words "previous fame" are used instead of -- previous frame --
Line 48, the word "quantsing" should be -- quantising --

Column 34,
Line 1, the words "including the:" should be replaced with -- including: --
Line 23, the words "firer combination" should read -- further combination --
Line 33, the words "energy composes" should read -- energy comprises --

Column 35,
Line 10, the word "predefined" should be -- pre-defined --
Line 58, the word "plural" should be replaced with -- plurality --
Line 62, the word "predefined" should be replaced with -- pre-defined --

Column 37,
Line 5, the words "masking sold for" should read -- masking threshold for --

Signed and Sealed this

Twenty-seventh Day of July, 2004

JON W. DUDAS
*Acting Director of the United States Patent and Trademark Office*